US011971047B2

(12) United States Patent
Frank et al.

(10) Patent No.: US 11,971,047 B2
(45) Date of Patent: Apr. 30, 2024

(54) EFFICIENT FAN ASSEMBLY

(71) Applicant: Greenheck Fan Corporation, Schofield, WI (US)

(72) Inventors: Thomas Frank, Schofield, WI (US); Vijaya Kumar Kollipara, Weston, WI (US); Shamus William Doran, Kronenwetter, WI (US); Matthew Keener, Lebanon, NH (US)

(73) Assignee: Greenheck Fan Corporation, Schofield, WI (US)

( * ) Notice: Subject to any disclaimer, the term of this patent is extended or adjusted under 35 U.S.C. 154(b) by 0 days.

(21) Appl. No.: 18/309,540

(22) Filed: Apr. 28, 2023

(65) Prior Publication Data

US 2023/0383761 A1 Nov. 30, 2023

Related U.S. Application Data

(63) Continuation of application No. 17/523,728, filed on Nov. 10, 2021, now Pat. No. 11,668,314.

(60) Provisional application No. 63/112,021, filed on Nov. 10, 2020.

(51) Int. Cl.

| | |
|---|---|
| ***F04D 29/18*** | (2006.01) |
| ***F04D 29/22*** | (2006.01) |
| ***F04D 29/24*** | (2006.01) |
| ***F04D 29/28*** | (2006.01) |
| ***F04D 29/38*** | (2006.01) |

(52) U.S. Cl.

CPC ..... *F04D 29/183* (2013.01); *F04D 29/2222* (2013.01); *F04D 29/242* (2013.01); *F04D 29/281* (2013.01); *F04D 29/384* (2013.01); *F04D 29/388* (2013.01)

(58) Field of Classification Search

CPC ..... F04D 29/181; F04D 29/183

See application file for complete search history.

(56) References Cited

U.S. PATENT DOCUMENTS

| | | | | |
|---|---|---|---|---|
| 2,467,296 | A | 4/1949 | Doe | |
| 3,217,976 | A | 11/1965 | Downs | |
| 4,133,374 | A * | 1/1979 | York | F28F 9/0131 110/304 |
| 5,745,834 | A | 4/1998 | Bampton et al. | |
| 5,932,055 | A | 8/1999 | Newell et al. | |
| 6,365,093 | B1 | 4/2002 | Ryang et al. | |
| 6,630,009 | B2 | 10/2003 | Moussa et al. | |
| 6,974,656 | B2 | 12/2005 | Hinczewski | |

(Continued)

FOREIGN PATENT DOCUMENTS

| | | |
|---|---|---|
| BE | 431438 | 1/1939 |
| CN | 104772854 A | 7/2015 |

(Continued)

OTHER PUBLICATIONS

International Search Report and Written Opinion for Application No. PCT/US2021/058827 dated Apr. 21, 2022.

*Primary Examiner* — Brian O Peters

(74) *Attorney, Agent, or Firm* — Merchant & Gould P.C.

(57) ABSTRACT

A fan assembly includes an internal housing having an outer internal housing, and an inner internal housing partially disposed within the outer internal housing. The inner internal housing defines an internal cavity, and has a curved exterior surface. Stator blades extend between the inner internal housing and the outer internal housing.

24 Claims, 35 Drawing Sheets

(56) References Cited

U.S. PATENT DOCUMENTS

| | | | | |
|---|---|---|---|---|
| 7,484,929 | B1 * | 2/2009 | Fitzpatrick | F04D 17/164 415/116 |
| 8,967,949 | B2 | 3/2015 | Gamissans Bou | |
| 9,114,571 | B2 | 8/2015 | You et al. | |
| 9,314,970 | B2 | 4/2016 | Elsworthy | |
| 9,327,447 | B2 | 5/2016 | Batchelder et al. | |
| 9,327,448 | B2 | 5/2016 | Shah et al. | |
| 9,364,986 | B1 | 6/2016 | Patterson | |
| 9,421,612 | B2 | 8/2016 | Fang et al. | |
| 9,421,713 | B2 | 8/2016 | Swanson et al. | |
| 9,512,544 | B2 | 12/2016 | Heikkila | |
| 9,694,545 | B2 | 7/2017 | Skubic et al. | |
| 9,737,182 | B2 | 8/2017 | Gindele et al. | |
| 2002/0129485 | A1 | 9/2002 | Mok et al. | |
| 2006/0286924 | A1 | 12/2006 | Milana | |
| 2014/0241894 | A1 | 8/2014 | Brownell et al. | |
| 2015/0097307 | A1 | 4/2015 | Batchelder et al. | |
| 2015/0097308 | A1 | 4/2015 | Batchelder et al. | |
| 2015/0125334 | A1 | 5/2015 | Uetani et al. | |
| 2015/0176603 | A1 | 6/2015 | Fetting et al. | |
| 2015/0218360 | A1 | 8/2015 | Barber et al. | |
| 2016/0052208 | A1 | 2/2016 | Debora et al. | |
| 2016/0083303 | A1 | 3/2016 | Mironets et al. | |
| 2016/0083304 | A1 | 3/2016 | Mironets et al. | |
| 2016/0151833 | A1 | 6/2016 | Tsao | |
| 2016/0236407 | A1 | 8/2016 | Armani et al. | |
| 2016/0236409 | A1 | 8/2016 | Armani et al. | |
| 2016/0256925 | A1 | 9/2016 | Heikkila | |
| 2016/0263827 | A1 | 9/2016 | Fripp et al. | |
| 2016/0289468 | A1 | 10/2016 | Turner | |
| 2016/0297097 | A1 | 10/2016 | Riman | |
| 2016/0339518 | A1 | 11/2016 | Nardi et al. | |
| 2017/0008082 | A1 | 1/2017 | Chen | |
| 2017/0028475 | A1 | 2/2017 | Heikkila | |
| 2017/0043395 | A1 | 2/2017 | She et al. | |
| 2017/0050374 | A1 | 2/2017 | Minardi et al. | |
| 2017/0080497 | A1 | 3/2017 | Tuffile et al. | |
| 2017/0144222 | A1 | 5/2017 | Daute et al. | |
| 2017/0203507 | A1 | 7/2017 | Leavitt et al. | |
| 2017/0251713 | A1 | 9/2017 | Warner et al. | |
| 2017/0266891 | A1 | 9/2017 | Skubic et al. | |
| 2017/0297109 | A1 | 10/2017 | Gibson et al. | |
| 2018/0281062 | A1 | 10/2018 | Cha et al. | |
| 2019/0255611 | A1 | 8/2019 | Frank et al. | |
| 2019/0270254 | A1 | 9/2019 | Mark et al. | |
| 2019/0366628 | A1 | 12/2019 | Guillory et al. | |

FOREIGN PATENT DOCUMENTS

| | | | |
|---|---|---|---|
| CN | 104924612 | A | 9/2015 |
| CN | 205058623 | U | 3/2016 |
| CN | 106272881 | A | 1/2017 |
| CN | 207120486 | U | 3/2018 |
| CN | 207224585 | U | 4/2018 |
| DE | 102014018081 | A1 | 6/2016 |
| DE | 102016222525 | A1 | 5/2018 |
| EP | 2759711 | | 7/2014 |
| EP | 3117982 | A1 | 1/2017 |
| EP | 3357673 | A1 | 8/2018 |
| WO | 2016014545 | A1 | 1/2016 |
| WO | 2016133853 | A1 | 8/2016 |
| WO | 2016198291 | A1 | 12/2016 |
| WO | 2017057838 | A1 | 4/2017 |
| WO | 2017113165 | A1 | 6/2017 |
| WO | 2017113172 | A1 | 6/2017 |
| WO | 2017186565 | | 11/2017 |
| WO | 2017207293 | | 12/2017 |
| WO | 2018044869 | A1 | 3/2018 |
| WO | 2019092358 | | 5/2019 |

* cited by examiner

EXAMPLE PRIOR ART FAN WHEEL

Static Efficiency

| | |
|---|---|
| 1 | 5% |
| 2 | 26% |
| 3 | 40% |
| 4 | 58% |
| 5 | 61% |
| 6 | 68% |
| 7 | 70% |
| 8 | 69% |
| 9 | 66% |
| 10 | 62% |
| 11 | 55% |

IMPROVEMENT

| 50 % Point Difference | | % Improvement |
|---|---|---|
| 11% | | 220% |
| 25% | | 96% |
| 12% | | 24% |
| 6% | | 14% |
| 6% | | 10% |
| 6% | | 9% |
| 5% | | 7% |
| 5% | | 12% |
| 6% | | 13% |
| 6% | | 13% |
| 6% | | 11% |

EXAMPLE PRIOR ART FAN WHEEL

Static Efficiency

| | |
|---|---|
| 1 | 38% |
| 2 | 51% |
| 3 | 61% |
| 4 | 66% |
| 5 | 67% |
| 6 | 72% |
| 7 | 75% |
| 8 | 77% |
| 9 | 74% |
| 10 | 70% |
| 11 | 61% |

EFFICIENT FAN ASSEMBLY

CROSS-REFERENCE TO RELATED APPLICATIONS

This application is a continuation of U.S. patent application Ser. No. 17/523,728, filed Nov. 10, 2021, now U.S. Pat. No. 11,668,314; which claims priority to U.S. Provisional Patent Application No. 63/112,021 filed Nov. 10, 2020, the disclosures of which are incorporated herein by reference in their entireties.

BACKGROUND

An in-line fan assembly typically includes a housing having a fan rotor for moving an airflow stream through the housing. The housing is typically cylindrical in shape which requires specialized manufacturing equipment and processes in addition to limiting the types of materials that can be used. For example, in order to construct a traditional cylindrical fan housing, several pieces of equipment are required including: a roller, a seam welder, and a flange. Secondary components that require connection to the main structure (i.e., motor plate, bearing plate, turning vanes, and the like) can also require welding. Due to the significant welding amounts, tubular designs are traditionally constructed from hot-rolled steel, thereby additionally requiring paint. Other higher strength materials, such as stainless steel, are not as frequently used due to the difficulty of manufacturing tubes and curved shapes from such materials, and cost.

SUMMARY

In general terms, the present disclosure relates to fan assemblies for providing an airflow stream, and particularly to in-line fan assemblies. Various aspects are described in this disclosure, which include, but are not limited to, the following aspects.

In one aspect, a fan assembly comprises: an external housing; a bell inlet positioned inside the external housing; an internal housing positioned inside the external housing, the internal housing including: an outer internal housing; an inner internal housing at least partially disposed within the outer internal housing, the inner internal housing defining an internal cavity, and having: a first diameter at a first end; a second diameter at a second end; and a maximum diameter between the first and second ends, the maximum diameter being greater than the first and second diameters, and having a curved exterior surface for defining an annulus between the inner internal housing and the external housing; and stator blades extending between the inner internal housing and the outer internal housing, the stator blades having an air-foil shape; an electric motor housed inside the internal cavity defined by the inner internal housing, the electric motor having a motor shaft; and a fan wheel having a hub coupled to the motor shaft, the fan wheel including fan blades extending from the hub to an inner surface of a wheel cone, the hub having a dome-shape with a diameter matching the first diameter of the inner internal housing.

In another aspect, an internal housing for a fan assembly comprises: an outer internal housing; an inner internal housing at least partially disposed within the outer internal housing, the inner internal housing defining an internal cavity, and having: a first diameter at a first end; a second diameter at a second end; and a maximum diameter between the first and second ends, the maximum diameter being greater than the first and second diameters, and defining a curved exterior surface for the inner internal housing extending from the first end to the second end; and stator blades extending between the inner internal housing and the outer internal housing.

In another aspect, a fan assembly comprises: an external housing; a bell inlet positioned inside the external housing; an internal housing positioned inside the external housing, the internal housing including: an outer internal housing; an inner internal housing at least partially disposed within the outer internal housing, the inner internal housing defining an internal cavity, and having a first diameter at a first end, a second diameter at a second end, and a maximum diameter between the first and second ends, the maximum diameter being greater than the first and second diameters, and having a curved exterior surface for defining an annulus between the inner internal housing and the external housing, the annulus increasing in size by about 80% from the maximum diameter of the inner internal housing to an end of the external housing; and stator blades extending between the inner and outer internal housings; an electric motor housed inside the internal cavity defined by the inner internal housing, the electric motor having a motor shaft; and a fan wheel having a hub coupled to the motor shaft, the fan wheel including fan blades extending from the hub to an inner surface of a wheel cone.

In some examples, the outer internal housing, the inner internal housing, and the stator blades are produced as a single, integral component such that the internal housing is produced as a monolithic part without any welds or attachment features.

In some examples, the internal housing is produced by 3D printing.

In some examples, the external housing is made of galvanized steel, and the internal housing is made of a material providing spark resistance.

In some examples, the outer internal housing defines an inner surface that is continuous with the inner surface of the wheel cone.

In some examples, the inner surface defined by the outer internal housing is inclined at an angle with respect to a central axis of the internal housing.

In some examples, at least one of the stator blades includes a channel extending from the internal cavity to the outer internal housing.

In some examples, the annulus increases in size from the maximum diameter of the inner internal housing to an end of the external housing.

In some examples, the fan assembly is mounted in an array of fan assemblies configured for cooling a data center.

In some examples, the internal housing is produced as a monolithic part without any welds or attachment features.

In some examples, the internal housing is made of a copolymer material providing spark resistance.

In some examples, the outer internal housing defines an inner surface inclined at an angle with respect to a central axis of the internal housing.

In some examples, the bell inlet defines an inlet diameter, the annulus defines an outer diameter, and the outer diameter of the annulus is about 50% larger than the inlet diameter.

A method of generating an air movement device design can include providing a fan design system; receiving, at the fan design system, performance requirements of the air movement device; creating, with the fan design system, one or more fan designs satisfying the performance requirements and that satisfies manufacturing requirements relating to an additive manufacturing process; and creating a Pareto front from the one or more created fan designs to identify an optimized subset of the one or more fan designs; and selecting a fan assembly based on a fan design from the optimized subset.

In some examples, the creating one or more fan design steps includes first creating one or more fan designs satisfying the performance requirements and then identifying a subset of the one or more fan designs that satisfy the manufacturing requirements.

In some examples, the performance requirements are received via a graphics user interface.

In some examples, the method further includes receiving an order to manufacture the selected fan assembly.

In some examples, the method further includes manufacturing the fan assembly.

In some examples, the method further includes packaging and shipping the fan assembly.

In some examples, the performance requirements include one or more of: fan type, application type, drive type, discharge type, mounting type and location, system type, fan size, fan nominal, minimum, and maximum operating points including airflow volume, external static pressure, efficiency, and/or brake horsepower, fan operating conditions including ambient air temperature, airstream temperature, elevation, fan material type, supply voltage and/or power type, and anticipated operating costs.

In some examples, the manufacturing requirements include one or more of: whether the fan assembly can be manufactured with an additive manufacturing process, material cost, manufacturing cost, manufacturing time, sales price, and fan wheel structural strength.

A method of generating an air movement device design can include receiving, from a customer, performance requirements of the air movement device fan at a graphics user interface; and calculating, and automatically placing an order for the air movement device based on the fan performance requirements input directly by a customer.

An air movement device can include a base defining an outer surface; and a plurality of fan blades supported by and extending from the base; wherein each of the plurality of fan blades projects into the base such that a portion of the fan blade extends below the base outer surface.

An additively manufactured HVAC fan design can include a base; a plurality of fan blades supported by and extending from the base; wherein the fan has an outside diameter of between 0 inches and 30 inches; wherein the fan wheel is configured to produce an airflow output of between 0 cfm and 5000 cfm at back pressures of between 0 and 30 inches of water.

An additively manufactured HVAC fan can include a base; a wheel cone; and a plurality of curved fan blades supported by and extending from the base to the wheel cone; wherein each of the fan blades has a leading edge, a trailing edge, and upper and lower surfaces extending between the leading and trailing edges; wherein the leading edges of the fan blades converge together towards a longitudinal center of the fan.

DESCRIPTION OF THE FIGURES

The following drawing figures, which form a part of this application, are illustrative of the described technology and are not meant to limit the scope of the disclosure in any manner.

FIG. 8 is a front isometric view of the fan wheel attached to the electric motor of

FIG. 7.

FIG. 9. is a rear isometric view of the fan wheel attached to the electric motor of

FIG. 7.

DETAILED DESCRIPTION

Figure 1:
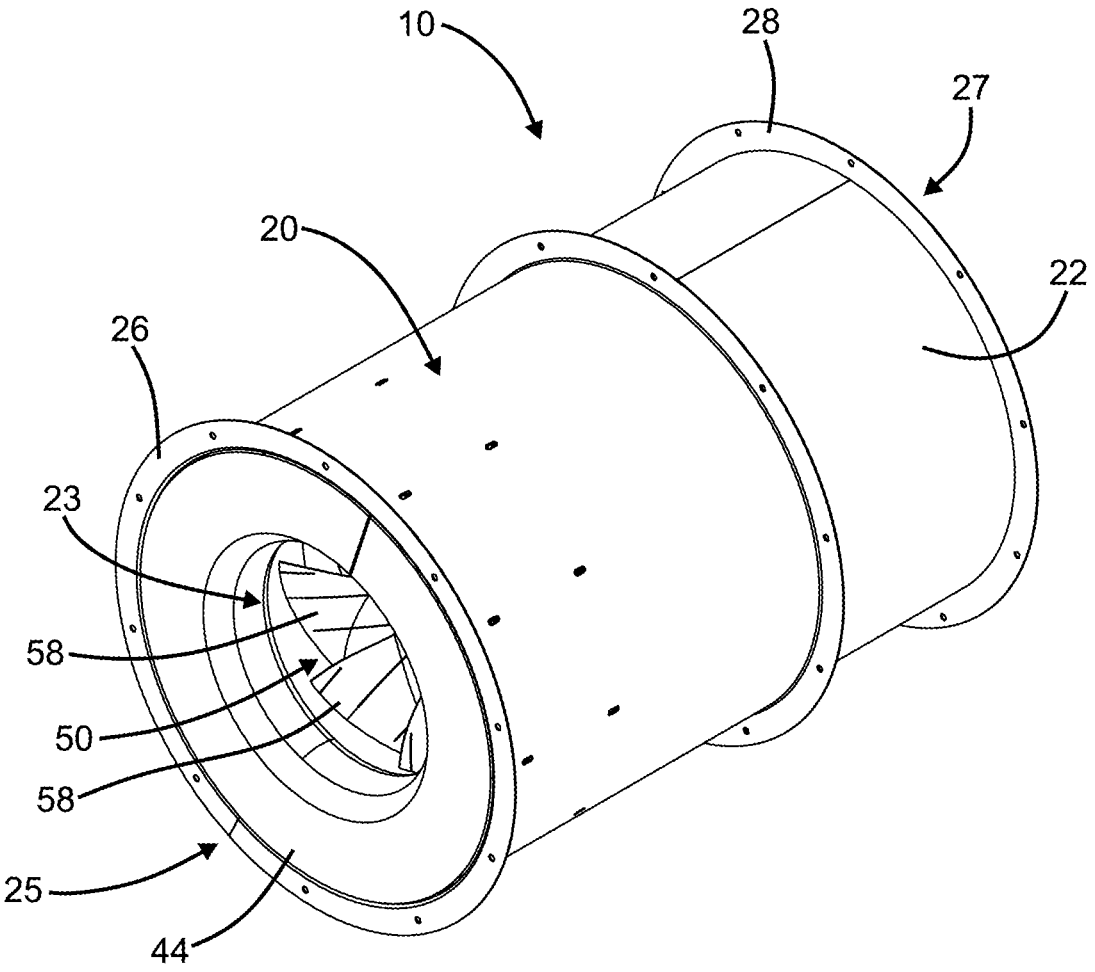
FIG. 1 is a front perspective view of an example of a fan assembly.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a front perspective view of an example of a fan assembly 10. The fan assembly 10 can be used to transport air, such as through a ducting system (not shown) relating to a building heating, ventilation, and air conditioning system. In some instances, the fan assembly 10 is a direct drive tubular inline fan that can safely exhaust lower flow applications containing odorous air and lower concentrations of fumes or contaminants. Example applications for which the fan assembly 10 can be utilized include, without limitation, battery room exhaust, cannabis production and processing, combustible gases, solvents, oils, alcohol and other chemical storage areas, trash rooms and other odorous exhaust fumes, and data center cooling.

Figure 2:
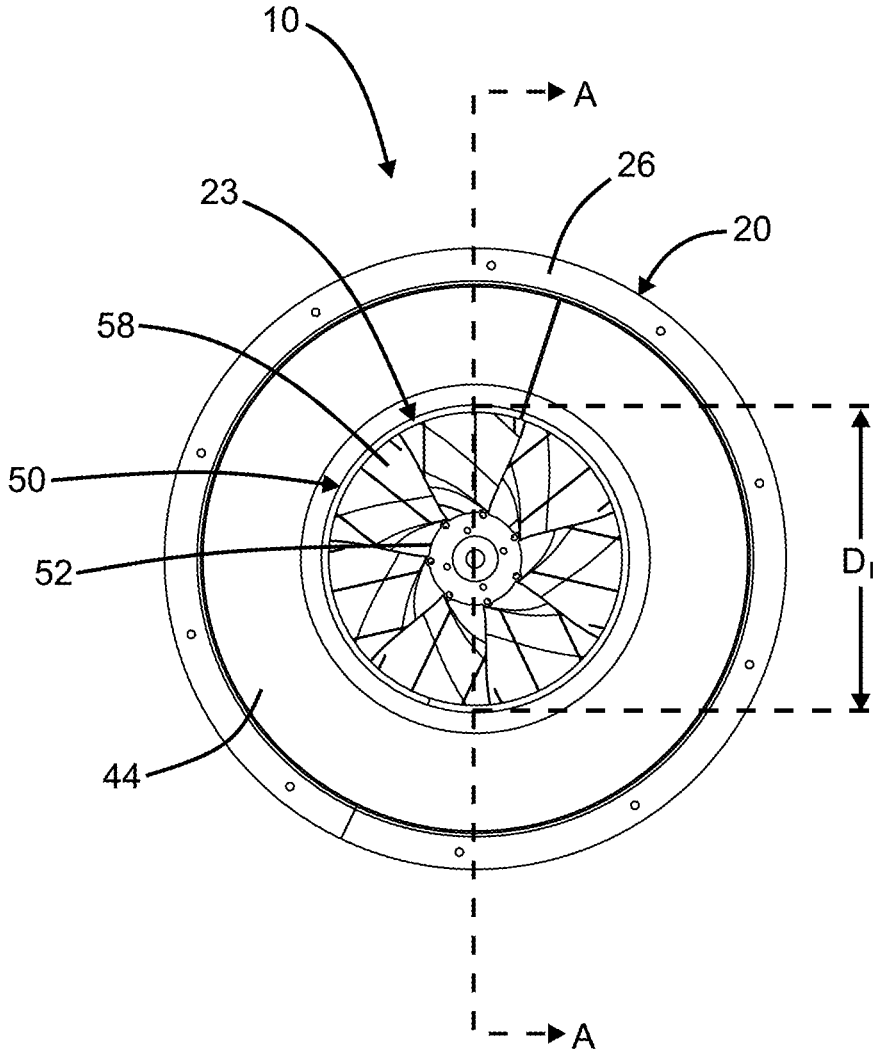
FIG. 2 is a front view of the fan assembly of FIG. 1.
Figure 3:
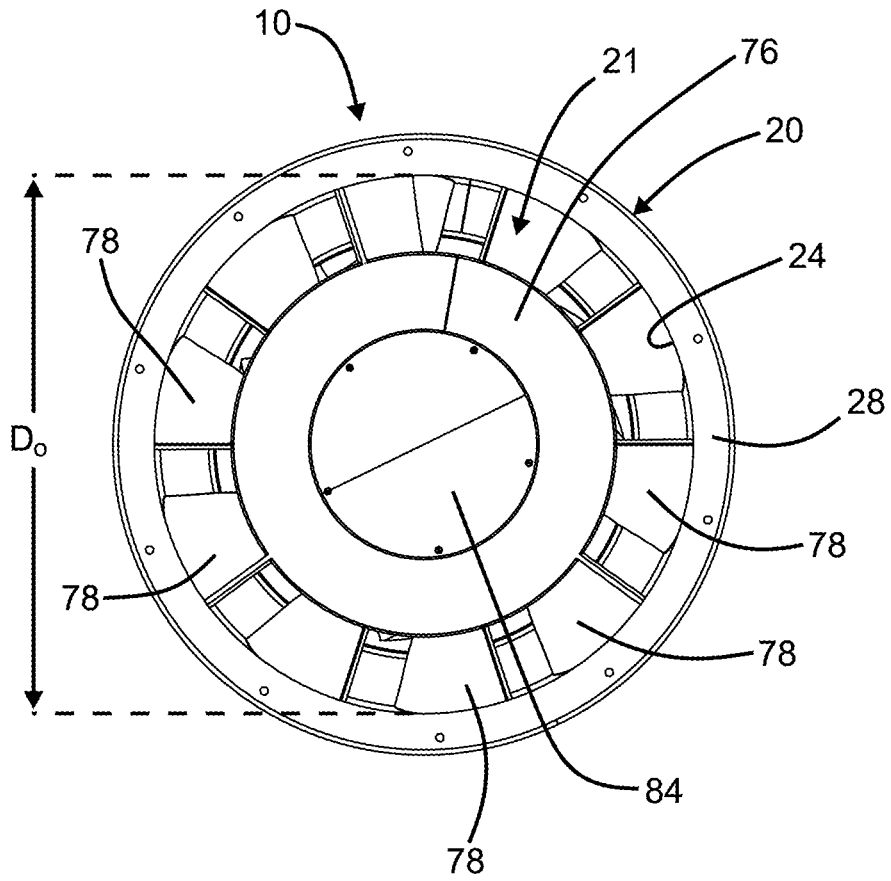
FIG. 3 is a rear view of the fan assembly of FIG. 1.
Figure 5:
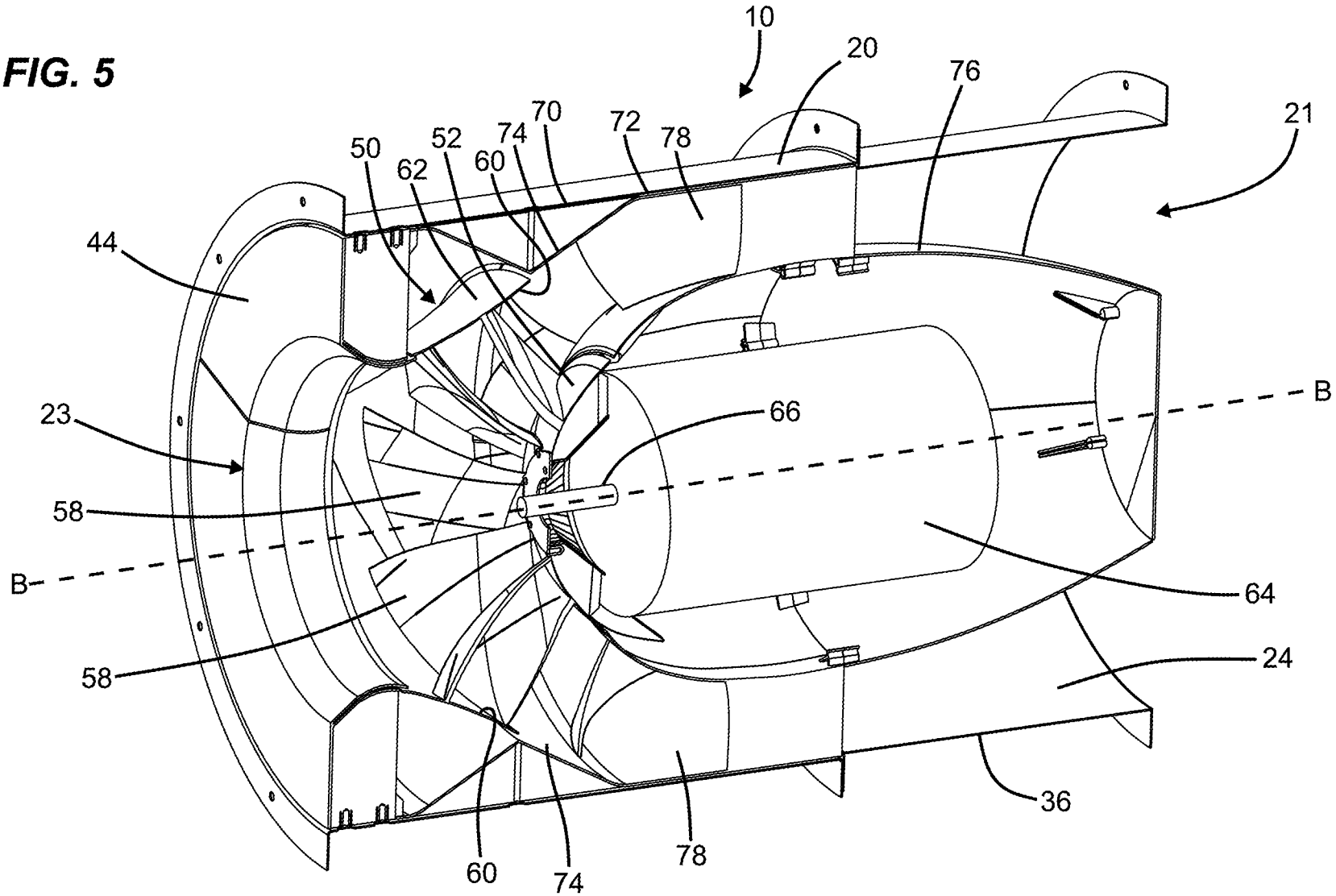
FIG. 5 is a perspective cross-sectional view of the fan assembly of FIG. 1, taken along the line A-A shown in FIG. 2.
Figure 6:
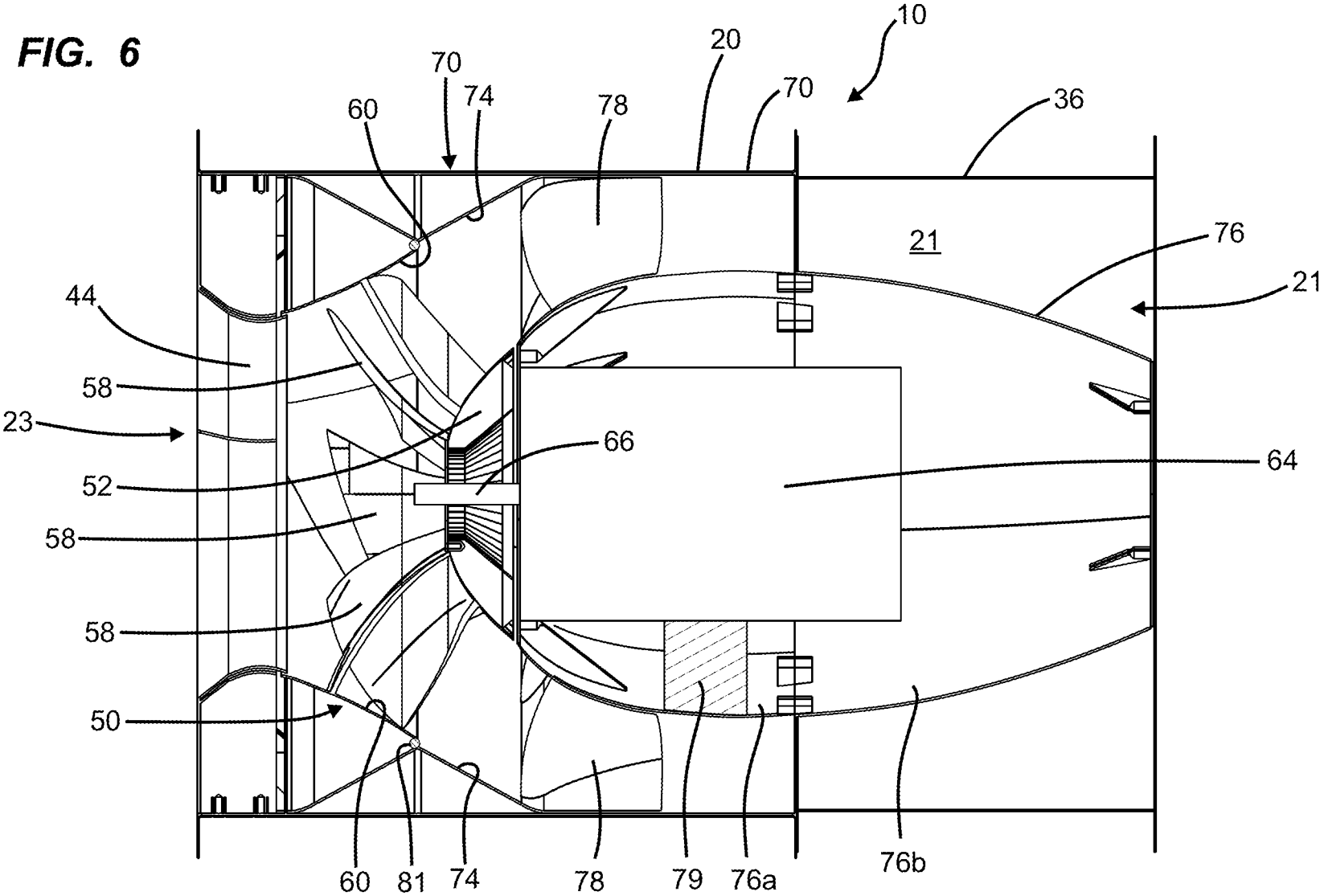
FIG. 6 is another cross-sectional view of the fan assembly of FIG. 1, taken along the line A-A shown in FIG. 2.

FIGS. 2 and 3 are respective front and rear views of the fan assembly 10. As shown in FIGS. 1-3, the fan assembly 10 includes an external housing 20 that is generally cylindrical in shape. The external housing 20 extends between a first end 25 and a second end 27. The external housing 20 defines an outer surface 22 and an inner surface 24 (see FIG. 3). As shown in FIG. 3, an annulus 21 is at least partly defined between the inner surface 24 of the external housing 20 and an inner internal housing 76 at the rear of the fan assembly 10. In certain examples, the annulus 21 is at least partly defined between a second housing portion 36 of the external housing 20 and the inner internal housing 76, as shown in FIGS. 5 and 6. In some examples, the annulus 21 has an outer diameter $D_O$ of about 16 inches to about 48 inches.

The external housing 20 is shown as having a first flange 26 and a second flange 28. The first and second flanges 26, 28 allow the fan assembly 10 to be connected to a ducting system or other equipment including structures that support an array of fans (see FIG. 20). For example, the first and second flanges 26, 28 allow the external housing 20 to meet standard flanged duct connections. In some examples, the external housing 20 is made from galvanized steel. In other examples, the external housing 20 can be made from a polymer.

Figure 4:
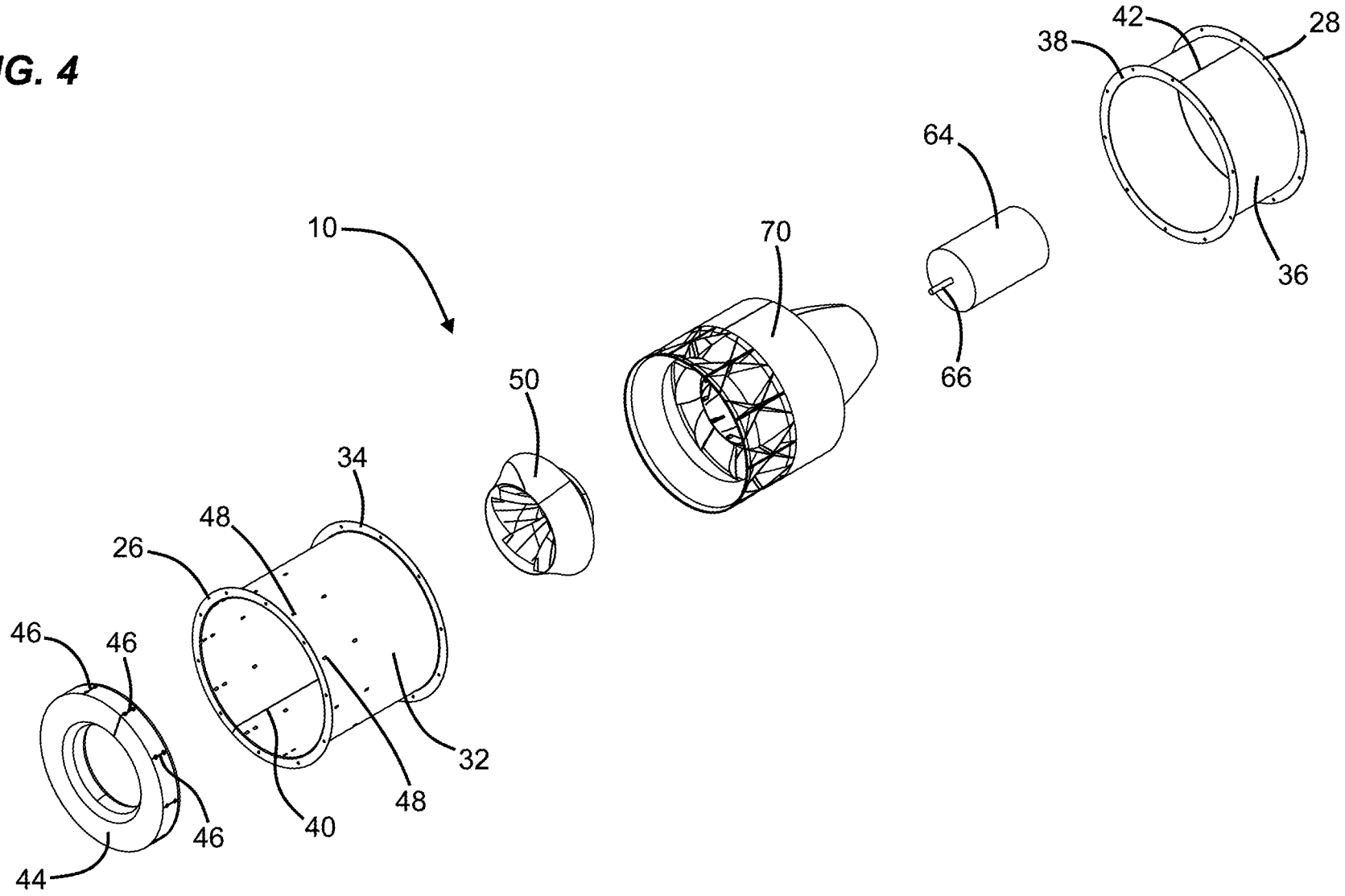
FIG. 4 is a perspective exploded view of the fan assembly of FIG. 1.

FIG. 4 is a perspective exploded view of the fan assembly 10. Referring now to FIGS. 1-4, the external housing 20 can include a first housing portion 32 that attaches to the second housing portion 36. For example, the first housing portion 32 can include a third flange 34 that can attach to a fourth flange 38 of the second housing portion 36 by fasteners such as screws. Also, the third and fourth flanges 34, 38 can be used to attach the fan assembly 10 to a ducting system or other equipment including a structure that supports an array of fans (see FIG. 20).

The first and second housing portions 32, 36 can each be formed by rolling sheets of material, and joining the ends of the sheets of material together at respective seams 40, 42. In some examples, the ends of the sheets of material can be joined together at the seams 40, 42 by a welding process. For example, plasma arc welding can be performed without significantly damaging a galvanized protective coating around the area of the seams 40, 42. Also, plasma arc welding can minimize the height of the welded seams, thereby reducing or eliminating the need to grind the seams 40, 42 prior to forming the flanges of the first and second housing portions 32, 36. The external housing 20 can be manufactured with minimal or no additional post processing to protect the areas around the seams 40, 42, such as by using paint or other protective coatings.

In another example embodiment, the first and second housing portions 32, 36 can be made of a polymer material. In such examples, the polymer material is opaque to block or prevent ultraviolet (UV) light from penetrating through the external housing 20.

FIGS. 5 and 6 are cross-sectional views of the fan assembly 10, each taken along the line A-A shown in FIG. 2. Referring now to FIGS. 1 and 4-6, the fan assembly 10 includes a bell inlet 44 that guides air toward the inside of the fan assembly 10. For example, the air is guided by the bell inlet 44 toward a fan wheel 50 which is mounted inside an internal housing 70 of the fan assembly 10, which is shown in more detail in FIGS. 13-17. Advantageously, the bell inlet 44 can be produced by 3D printing which can improve the speed of manufacture and reduce manufacturing costs.

The bell inlet 44 is positioned inside the first end 25 of the external housing 20. For example, the bell inlet 44 is positioned inside the first housing portion 32 once the first housing portion 32 is formed by the rolling and welding processes described above. As shown in FIG. 2, the bell inlet 44 defines an inlet 23 at the front of the fan assembly 10. The inlet 23 has an inlet diameter $D_I$ that is smaller than the outer diameter $D_O$ of the annulus 21. In some examples, the inlet diameter $D_I$ is about 9 inches to about 27 inches. As an example, the outer diameter $D_O$ of the annulus 21 is about 50% larger than the inlet diameter $D_I$ of the inlet 23.

As shown in FIG. 4, the bell inlet 44 includes apertures 46 that align with apertures 48 on the first housing portion 32. This allows fasteners such as screws to be inserted through the apertures 46, 48 for attaching the bell inlet 44 to the first housing portion 32.

Figure 7:
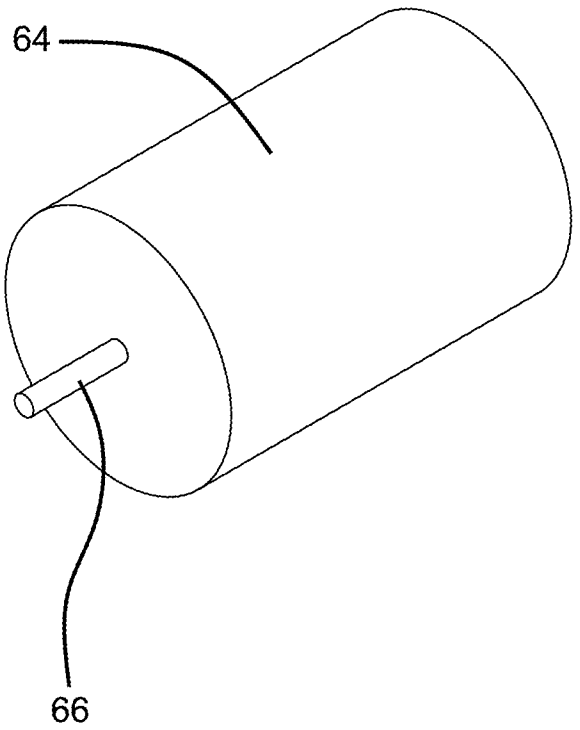
FIG. 7 is an exploded view of an example of a fan wheel and an electric motor that are components of the fan assembly of FIG. 1.
Figure 7:
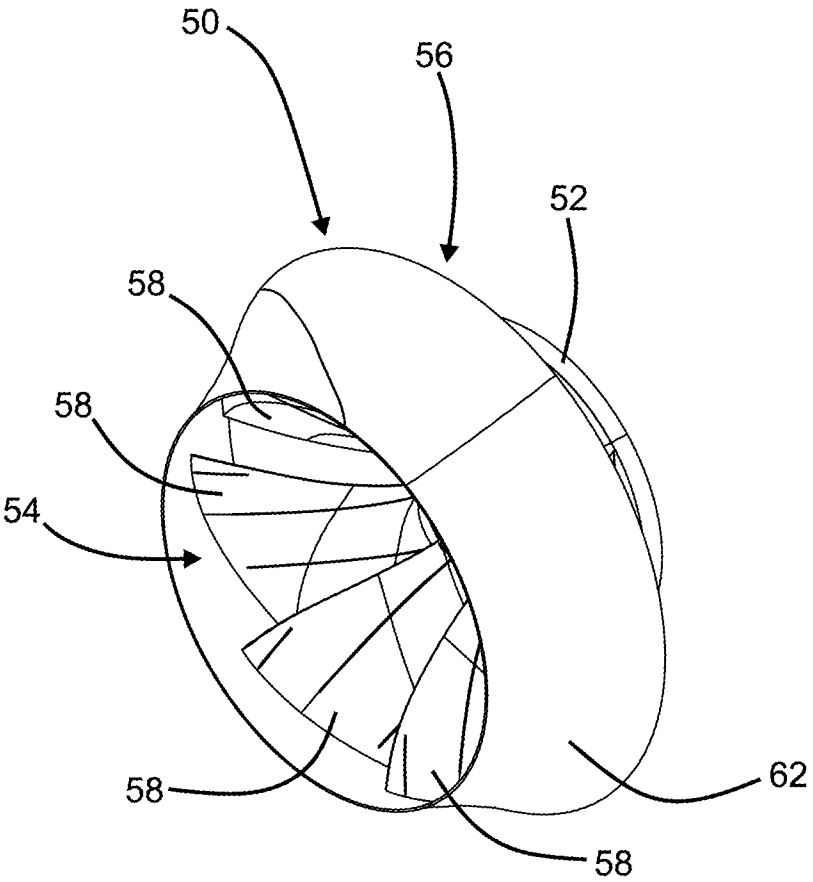
Figure 8:
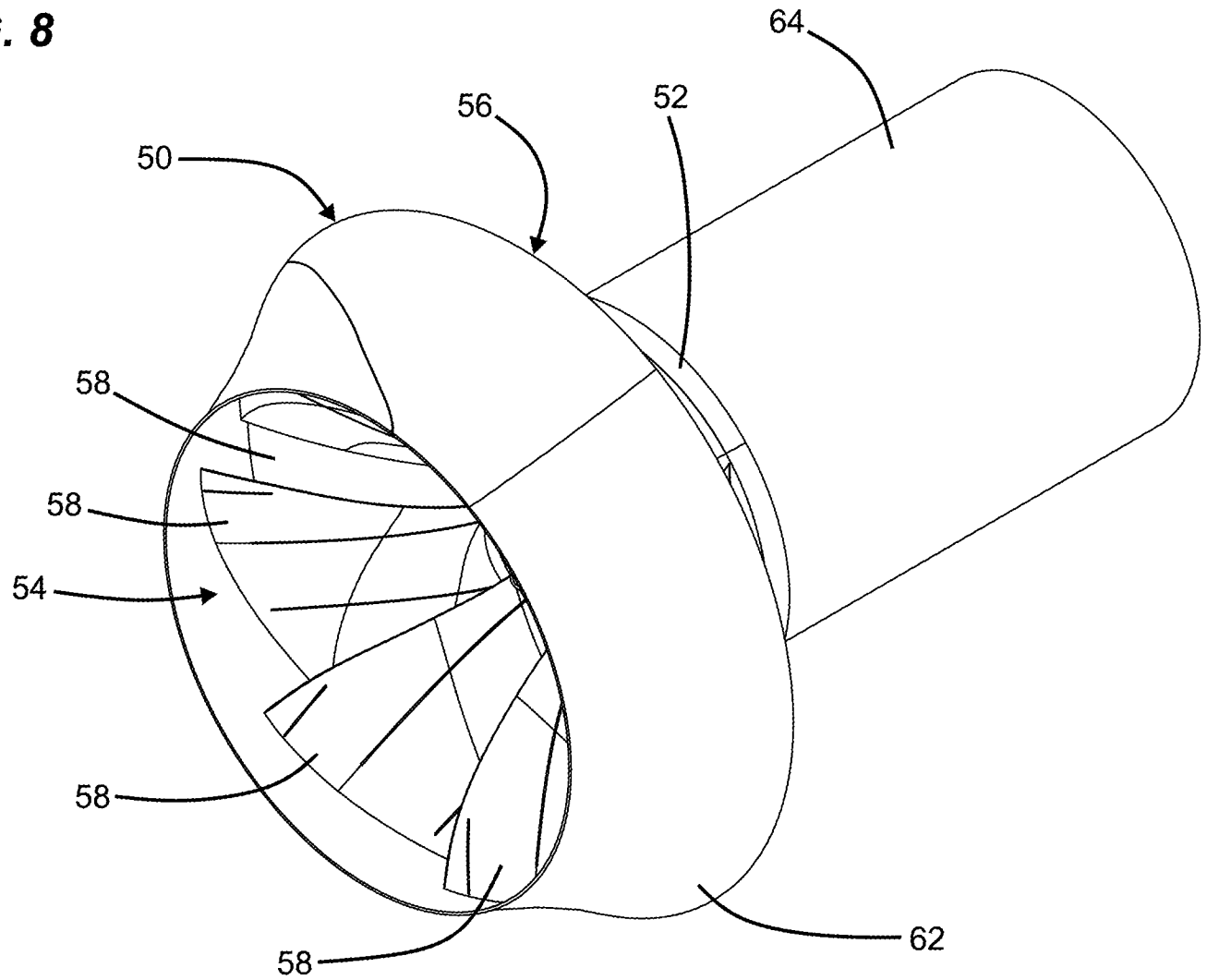
Figure 9:
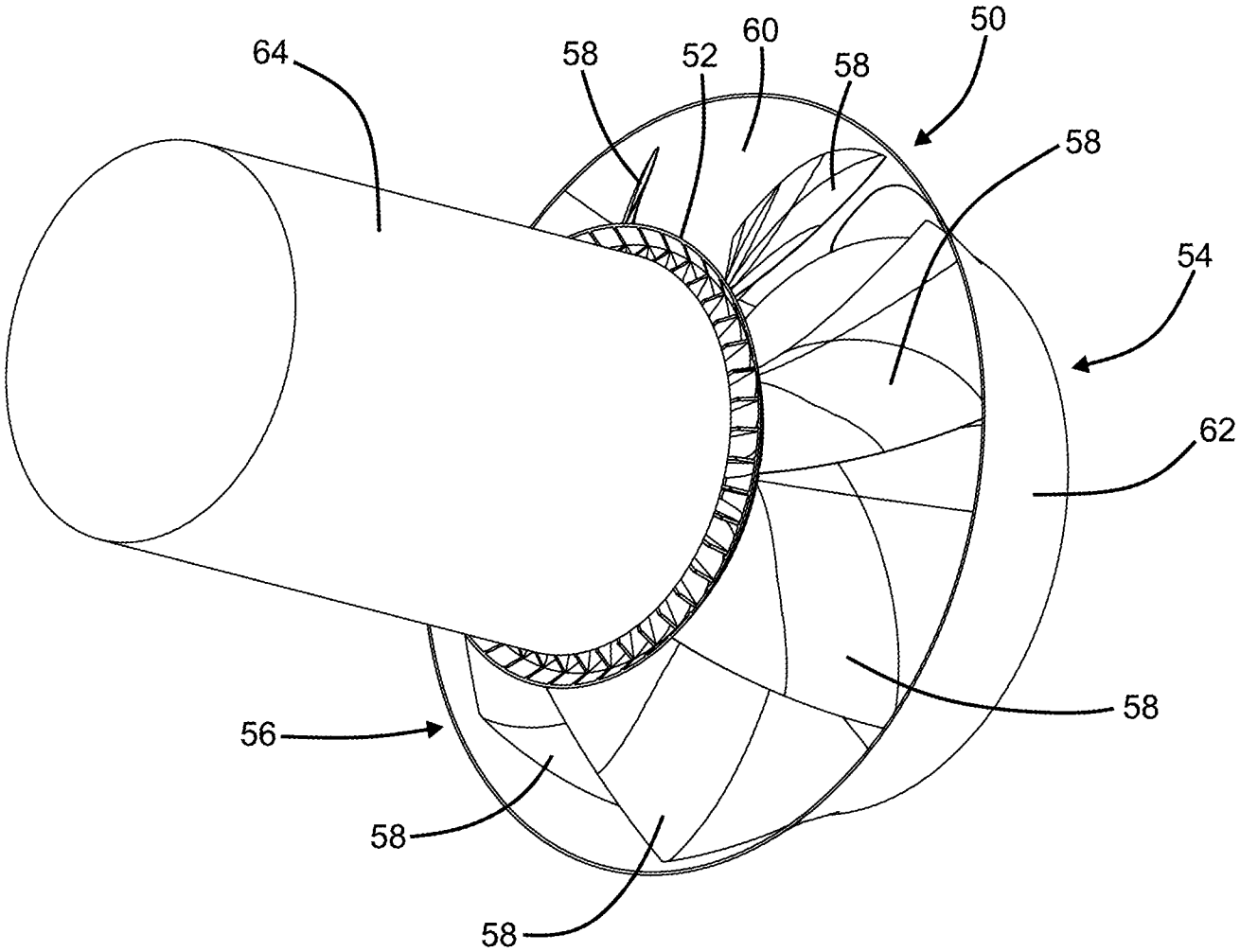
Figure 10:
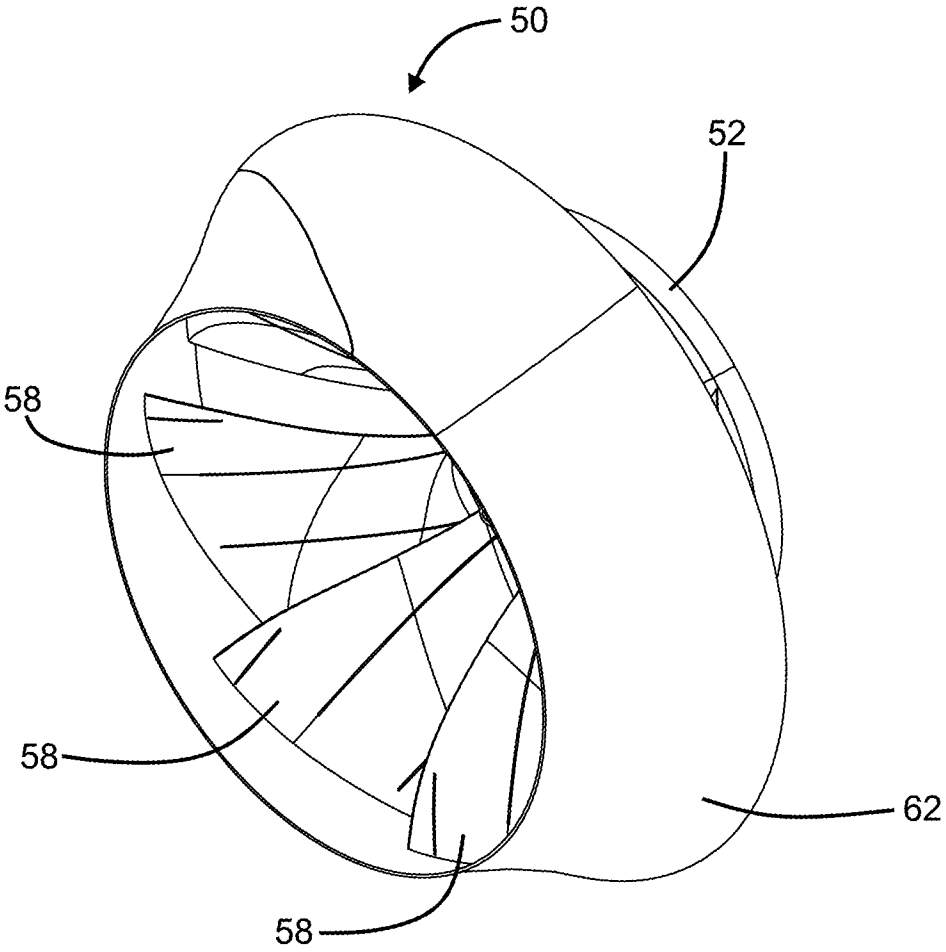
FIG. 10 is a front isometric view of the fan wheel of FIG. 7.
Figure 11:
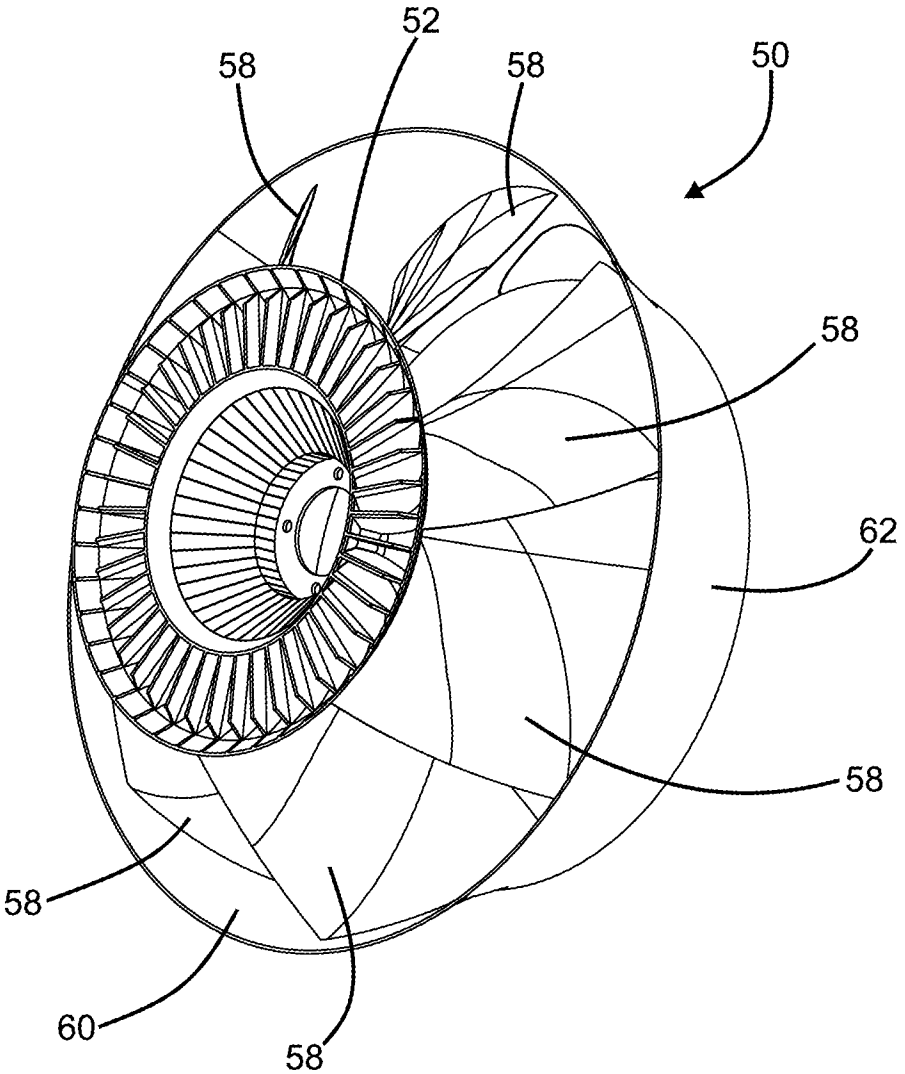
FIG. 11 is a rear isometric view of the fan wheel of FIG. 7.
Figure 12:
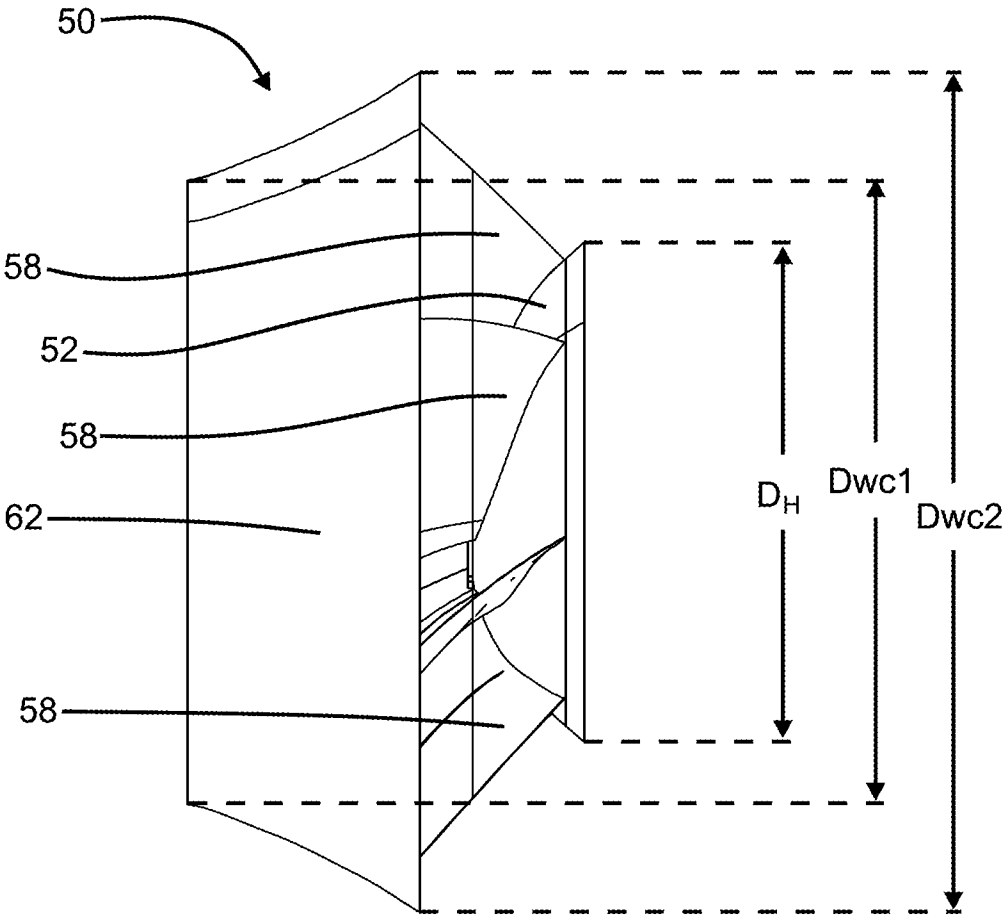
FIG. 12 is a side view of the fan wheel of FIG. 7.

FIG. 7 is an exploded view of an example of the fan wheel 50 and an electric motor 64 of the fan assembly 10. FIGS. 8 and 9 are front and rear isometric views of the fan wheel 50 attached to the electric motor 64. FIGS. 10-12 are respective front isometric, rear isometric, and side views of the fan wheel 50. The fan wheel 50 is driven by the electric motor 64 via a motor shaft 66. The fan wheel 50 includes a hub 52 that accepts a keyed or splined portion of the motor shaft 66 such that rotation of the motor shaft 66 causes rotation of the fan wheel 50. As an illustrative example, the electric motor 64 can be a 1 HP 115/208~277/60 Hz/1 phase motor, and that is an electronically commutated (EC) type of electric motor.

As the fan wheel 50 rotates, air is directed from an inlet end 54 to an outlet end 56. As shown in FIGS. 5, 6, and 10-12, the fan wheel 50 includes a plurality of fan blades 58. The fan blades 58 are radially disposed around the hub 52. The fan blades 58 can have an airfoil shape. As shown in FIGS. 5,6, and 12, the hub 52 is dome-shaped having a diameter $D_H$. In some examples, the diameter $D_H$ is about 7 inches to about 23 inches. The fan blades 58 extend from an outer surface of the hub 52 to an inner surface 60 of a wheel cone 62.

The wheel cone 62 has the shape of a truncated cone. As shown in FIG. 12, the wheel cone 62 has a first diameter $D_{WC1}$ and a second diameter $D_{WC2}$ that is larger than the first diameter $D_{WC1}$. In some examples, the first diameter $D_{WC1}$ is about 9 inches to about 28 inches. In some examples, the second diameter $D_{WC2}$ is about 12 inches to about 36 inches.

The hub 52, fan blades 58, and wheel cone 62 can be produced as a single, integral component, such that the fan wheel 50 is a monolithic part without any welds or other attachment features for joining the fan blades 58 to the hub 52 and the wheel cone 62. This can reduce the total number of parts in the fan assembly 10. The fan wheel 50 can be produced by 3D printing, in accordance with the examples described in U.S. Patent Publication No. 2019/0255611, which is hereby incorporated by reference in its entirety.

In operation, the fan blades 58 and the wheel cone 62 operate in conjunction to force or direct the airflow from the inlet end 54 of the fan wheel 50 towards the outlet end 56 of the fan wheel 50. This configuration is a "mixed flow" type fan configuration which shares characteristics of both centrifugal and axial type fans. As shown, the fan wheel 50 is provided with seven fan blades. However, more or fewer fan blades are possible, such as four, five, or six fan blades or up to twelve fan blades. The fan wheel 50 and constituent components can share characteristics with the fan wheel described in described in U.S. Patent Publication No. 2014/0241894, and in U.S. Patent Publication No. 2015/0176603, which are hereby incorporated by reference in their entireties.

Figure 13:
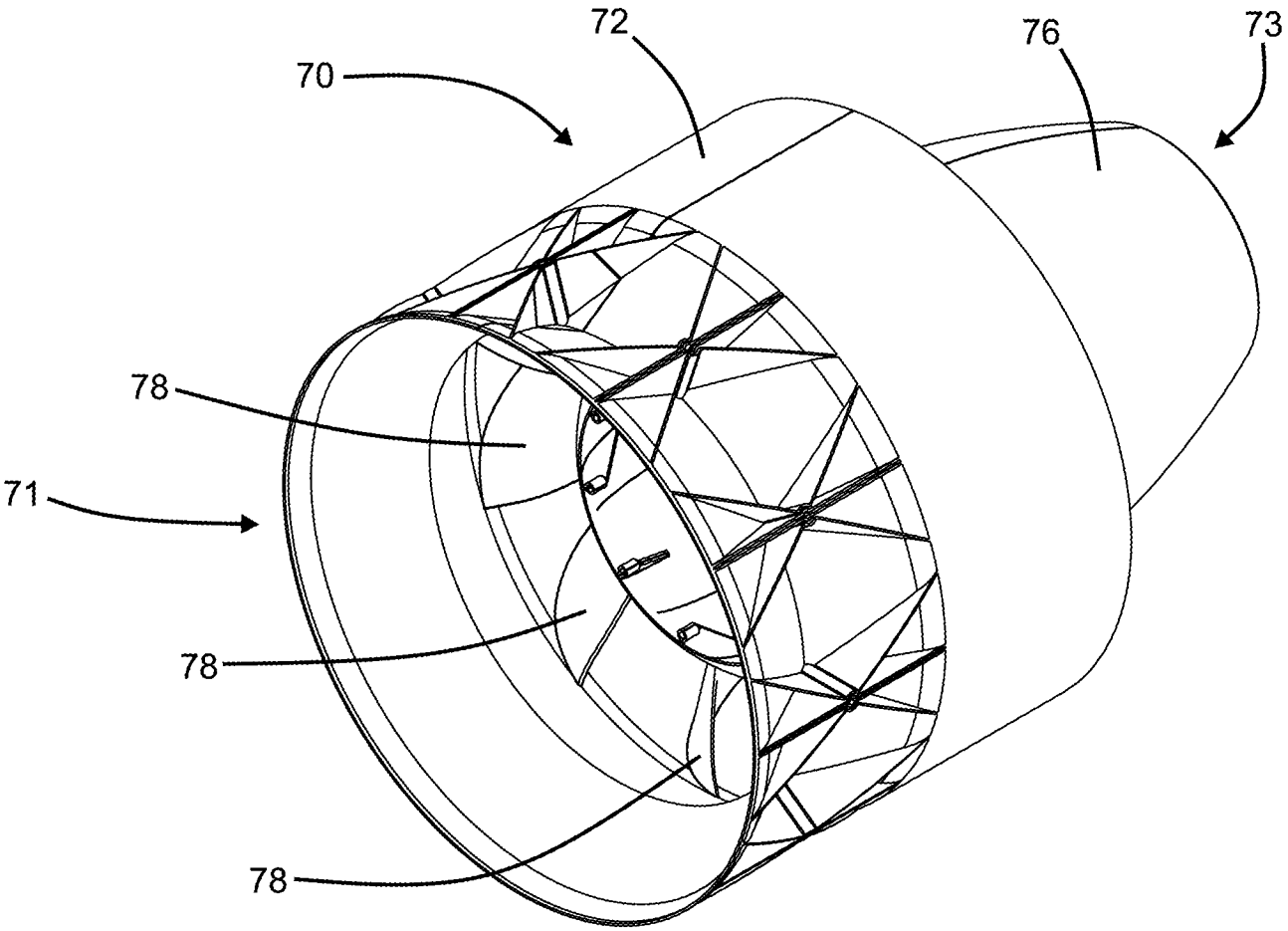
FIG. 13 is a front isometric view of the internal housing. that is a component of the fan assembly of FIG. 1
Figure 14:
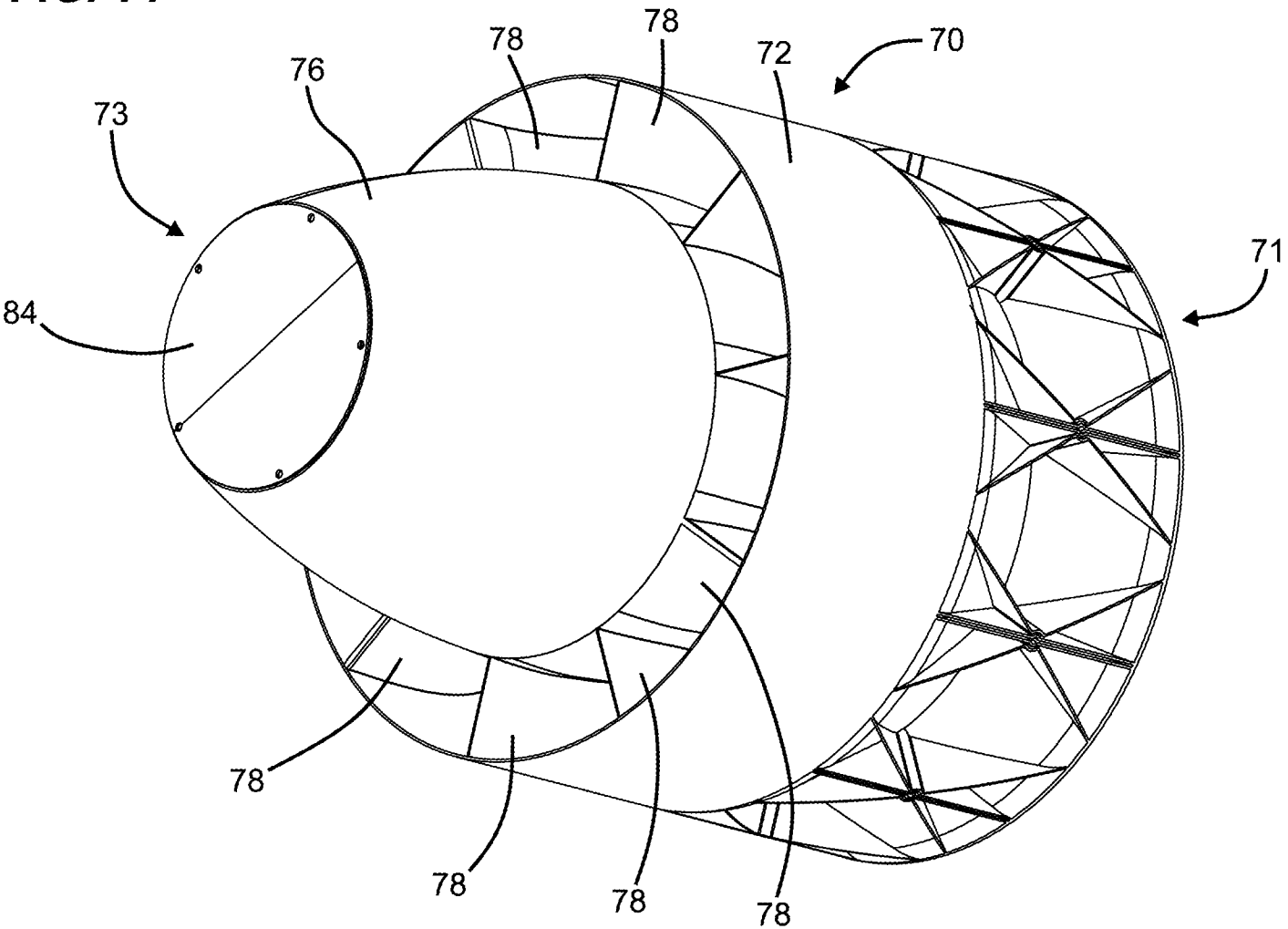
FIG. 14 is a rear isometric view of the internal housing of FIG. 13.
Figure 15:
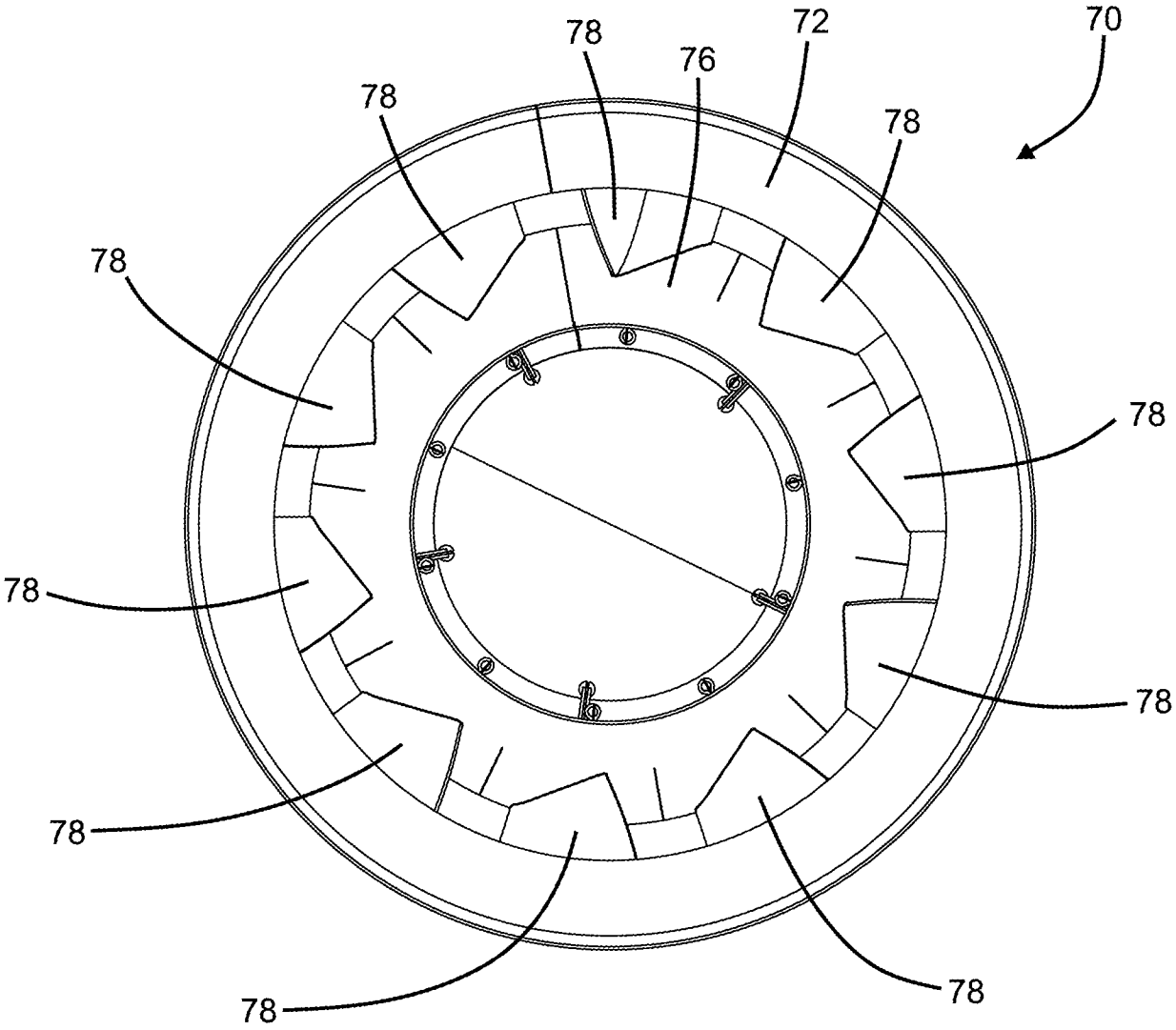
FIG. 15 is a front view of the internal housing of FIG. 13.
Figure 16:
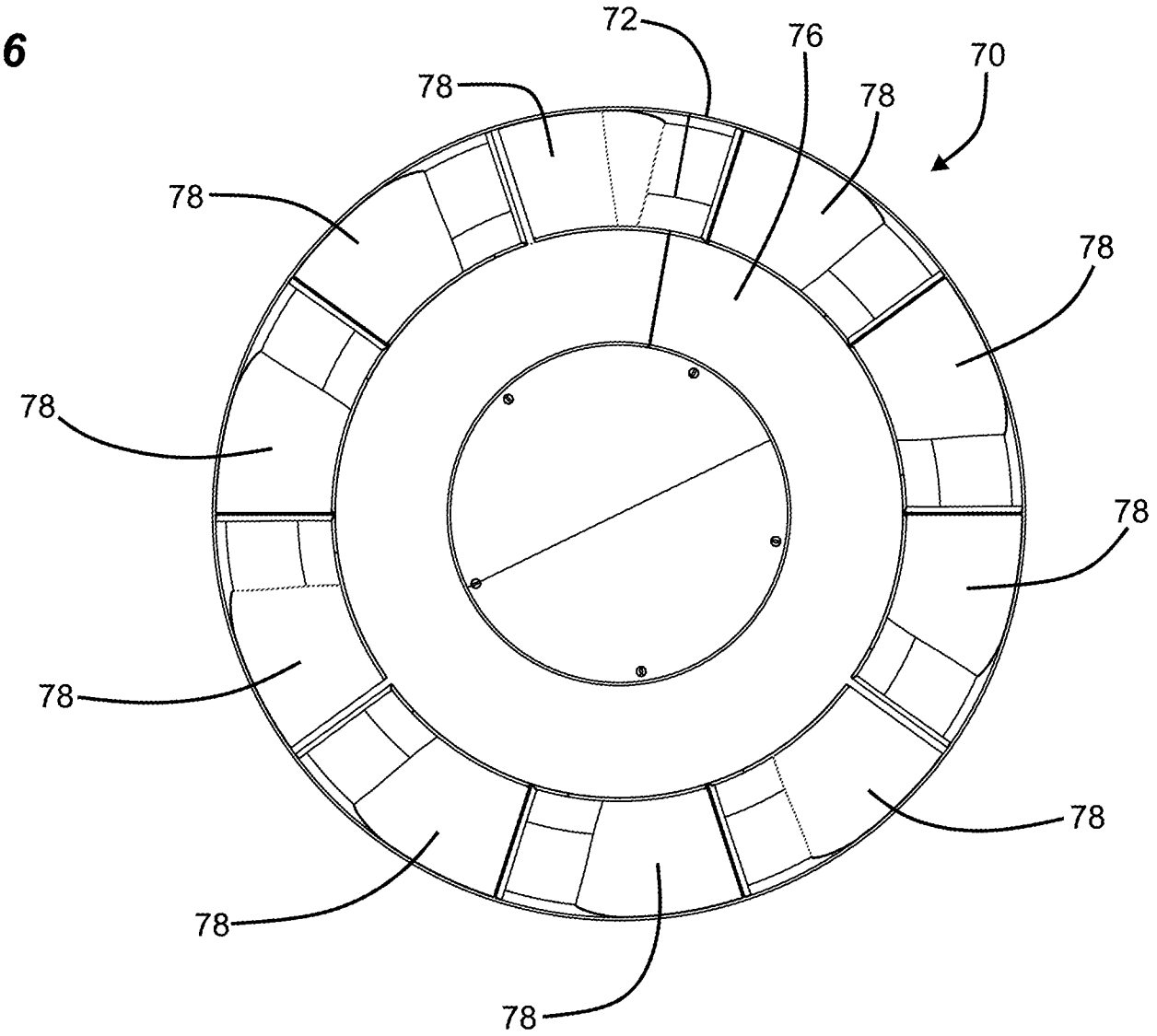
FIG. 16 is a rear view of the internal housing of FIG. 13.
Figure 17:
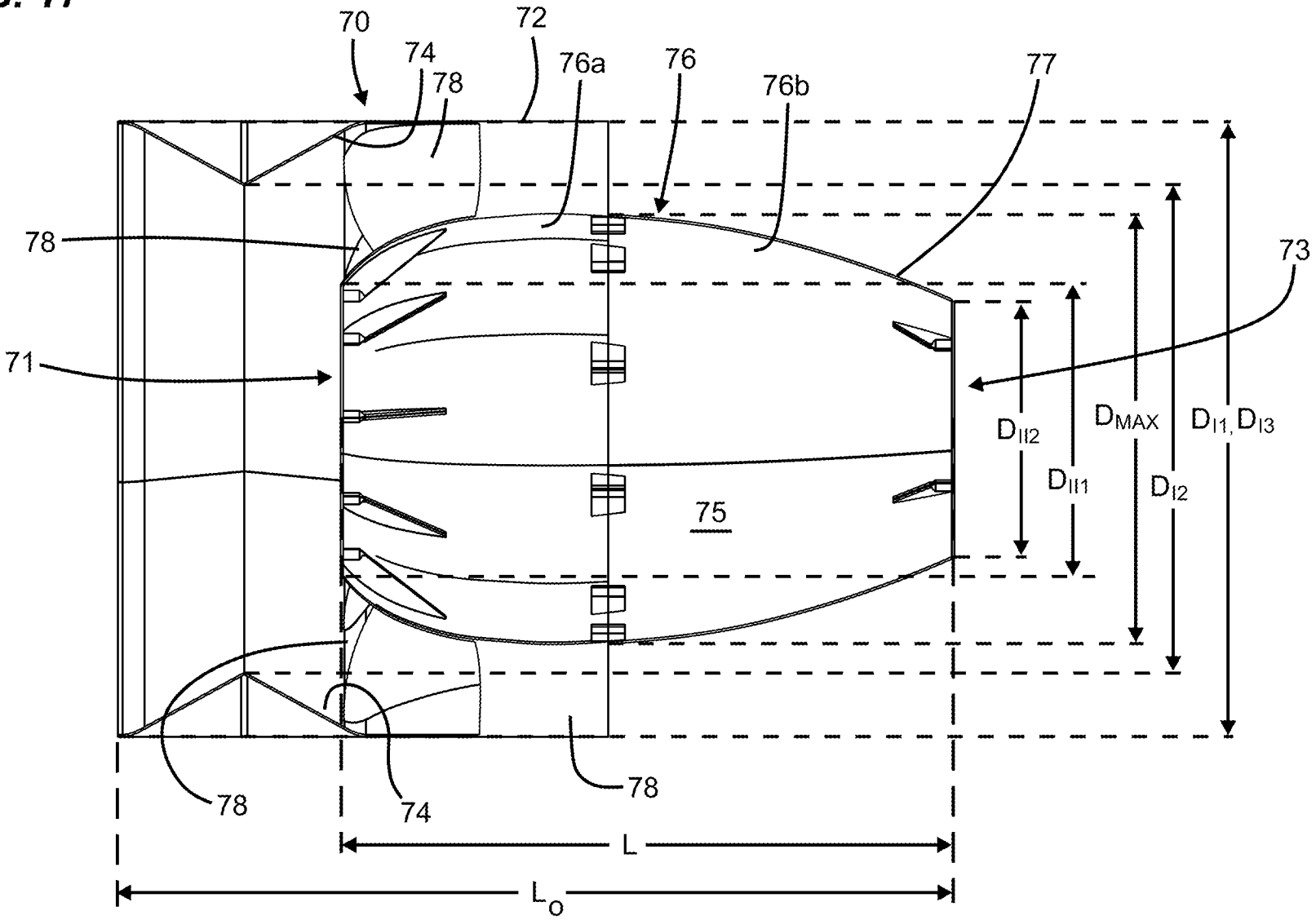
FIG. 17 is a cross-sectional view of the internal housing of FIG. 13.

The fan assembly 10 further includes an internal housing 70 that is housed inside the external housing 20. FIGS. 13 and 14 are respective front and rear isometric view of the internal housing 70. FIGS. 15 and 16 are respective front and rear views of the internal housing 70. FIG. 17 is a cross-sectional view of the internal housing 70 taken along the line A-A shown in FIG. 2.

As shown in FIG. 17, the internal housing 70 extends between a first end 71 and a second end 73. The internal housing 70 includes an outer internal housing 72 having a cylindrical exterior profile. At the first end 71, the outer internal housing 72 has a first internal diameter $D_{I1}$ and a second internal diameter $D_{I2}$. The second internal diameter $D_{I2}$ is smaller than the first internal diameter $D_{I1}$ such that the outer internal housing 72 defines an interior funnel shape. As an example, the first internal diameter $D_{I1}$ is about 16 inches to about 50 inches, and the second internal diameter $D_{I2}$ is about 12 inches to about 38 inches. As a further example, the second internal diameter $D_{I2}$ is about 25% smaller than the first internal diameter $D_{I1}$.

The interior funnel shape of the outer internal housing 72 at the first end 71 receives the fan wheel 50 such that the second internal diameter $D_{I2}$ is equal to or substantially similar to the second diameter $D_{WC2}$ of the wheel cone 62. As shown in FIGS. 5, 6, and 17, the outer internal housing 72 defines an inner surface 74 that is in close proximity with the inner surface 60 of the wheel cone 62, with the inner surface 74 having a slightly larger dimension than the wheel cone 62. In one example, a wear ring 81, which can be a soft, pliable gasket material, such as a polymeric and/or foam material, can be inserted between the wheel cone 62 and the inner surface 74 such that air leakage between the wheel cone 62 and the inner surface 74 is minimized or eliminated, thereby increasing efficiency. As shown in FIG. 5, the inner surface 60 of the wheel cone 62 and the inner surface 74 of the outer internal housing 72 are both inclined at a similar angle with respect to a central axis B-B of the internal housing 70 of the fan assembly 10. Such a structure and relationship can reduce the energy usage by the fan assembly 10, and thereby improve the efficiency of the fan assembly 10. In one example, the angle of the inner surface 74 and the inner surface 60 are within 10 degrees of each other, within 5 degrees of each other, or within 1 degree of each other, and the same angle.

The outer internal housing 72 at the second end 73 defines a third internal diameter $D_{I3}$. As shown in FIG. 17, the third internal diameter $D_{I3}$ is equal to or substantially similar to the first internal diameter $D_{I1}$, and is greater than the second internal diameter $D_{I2}$. Also, the third internal diameter $D_{I3}$ of the outer internal housing 72 is substantially similar to the outlet diameter $D_O$ defined by the external housing 20 at the rear of the fan assembly 10. In some examples, the third internal diameter $D_{I3}$ is about 16 inches to about 50 inches.

As further shown in FIG. 17, the internal housing 70 further includes an inner internal housing 76 that is disposed within the outer internal housing 72. The inner internal housing 76 defines an internal cavity 75 that is used for housing the electric motor 64. The inner internal housing 76 includes a covering 84 to enclose the electric motor 64 in a sealed compartment such that the electric motor 64 is shielded from the airflow, and does not come in contact with contaminants that pass through the internal housing 70. In one aspect, the inner internal housing 76 is formed by a first part **76*a* and a separate second part 76*b* joined to the first part, for example by fasteners. By constructing the inner internal housing 76 in such a way, the second part 76*b* can be removed to service the motor 64, when necessary. In the example shown, the first part 76*a* is formed integrally with stator blades 78 and the outer internal housing 72**.

As further shown in FIG. 17, the inner internal housing 76 has a first diameter $D_{II1}$ at the first end 71, a second diameter $D_{II2}$ at the second end 73, and a maximum diameter $D_{MAX}$ between the first and second ends 71, 73. The maximum diameter $D_{MAX}$ is greater than the first and second diameters $D_{II1}$, $D_{II2}$. As shown in the figures, the first, second, and maximum diameters $D_{II1}$, $D_{II2}$, $D_{MAX}$, define a curved exterior surface 77 that is continuous along the inner internal housing 76 as it extends from the first end 71 to the second end 73. In one example, a ratio R can be established as being the difference between the diameters $D_{I3}$ and $D_{II2}$ divided by an overall length $L_o$ of the internal housing 70. In examples, the ratio R is between 0.1 and 0.3, between 0.15 and 0.25, and about 0.17.

The curved exterior surface 77 defines a pathway inside the annulus 21 between the external housing 20 and the inner internal housing 76 for the airflow to pass through after the airflow passes through the fan wheel 50. The curved exterior surface 77 that shapes the annulus 21 between the external housing 20 and the inner internal housing 76 can improve the airflow, and can thereby improve the static efficiency of the fan assembly 10. As an illustrative example, the curved exterior surface 77 can improve the static efficiency of the fan assembly 10 by about 5% to about 8%.

The size of the annulus 21 increases starting from the maximum diameter $D_{MAX}$ of the inner internal housing 76 and ending at the second end 27 of the external housing 20. As an example, the size of the annulus 21 increases by about 80% from the maximum diameter $D_{MAX}$ of the inner internal housing 76 to the second end 27 of the external housing 20. In the example shown, the inner internal housing first part 76*a* forms the portion of the annulus 21 at the location where the annulus 21 is decreasing while the inner internal housing second part 76*b* forms the majority of the portion of the annulus 21 at the location where the annulus 21 is increasing.

Also, a length L of the inner internal housing 76 can improve the airflow, and can thereby improve the static efficiency of the fan assembly 10. In some examples, the length L of the inner internal housing 76 is about 16 to about 50 inches long.

The first diameter $D_{I1}$ of the inner internal housing 76 is equal to or substantially similar to the diameter $D_H$ of the hub 52. The hub 52 can attach adjacent to the inner internal housing 76, and the motor shaft 66 can extend from inside the internal cavity 75 to the hub 52 for rotating the fan blades 58. As shown in FIGS. 5 and 6, the dome shape of the hub 52 is continuous with the curved exterior surface 77 of the inner internal housing 76. In one aspect, both the hub 52 and the exterior surface 77 have a convex outer shape. The dome shape of the hub 52 and the curved exterior surface 77 provide the inner internal housing 76 with a continuous convex shape. This can further improve the air flow efficiency of the fan assembly By use of the term "continuous convex shape", it is meant to include variations between the angle of the hub 52 and the angle of inner internal housing 76 at the location where the two components are adjacent, for example variations of up 0 to 20 degrees, and is also meant to include configurations where a gap may exist between the hub 52 and the inner internal housing 76. In the example shown, at the location where the hub 52 and inner internal housing 76 meet, the outer surface of the hub 52 has an angle of about 42 degrees, relative to the central axis B-B, while the inner internal housing 76 has an angle over about 49 degrees such that the difference between angles is less than 10 degrees.

The internal housing 70 further includes a plurality of the stator blades 78 that are radially disposed around the inner internal housing 76. The stator blades 78 are fixed blades that do not rotate. In some instances, the stator blades 78 are referred to as vanes. The stator blades 78 can have an airfoil shape, and extend from the curved exterior surface 77 of the inner internal housing 76 to the inner surface 74 of the outer internal housing 72. As shown in the figures, the stator blades 78 are positioned at the maximum diameter $D_{MAX}$ of the inner internal housing 76.

Figure 18:
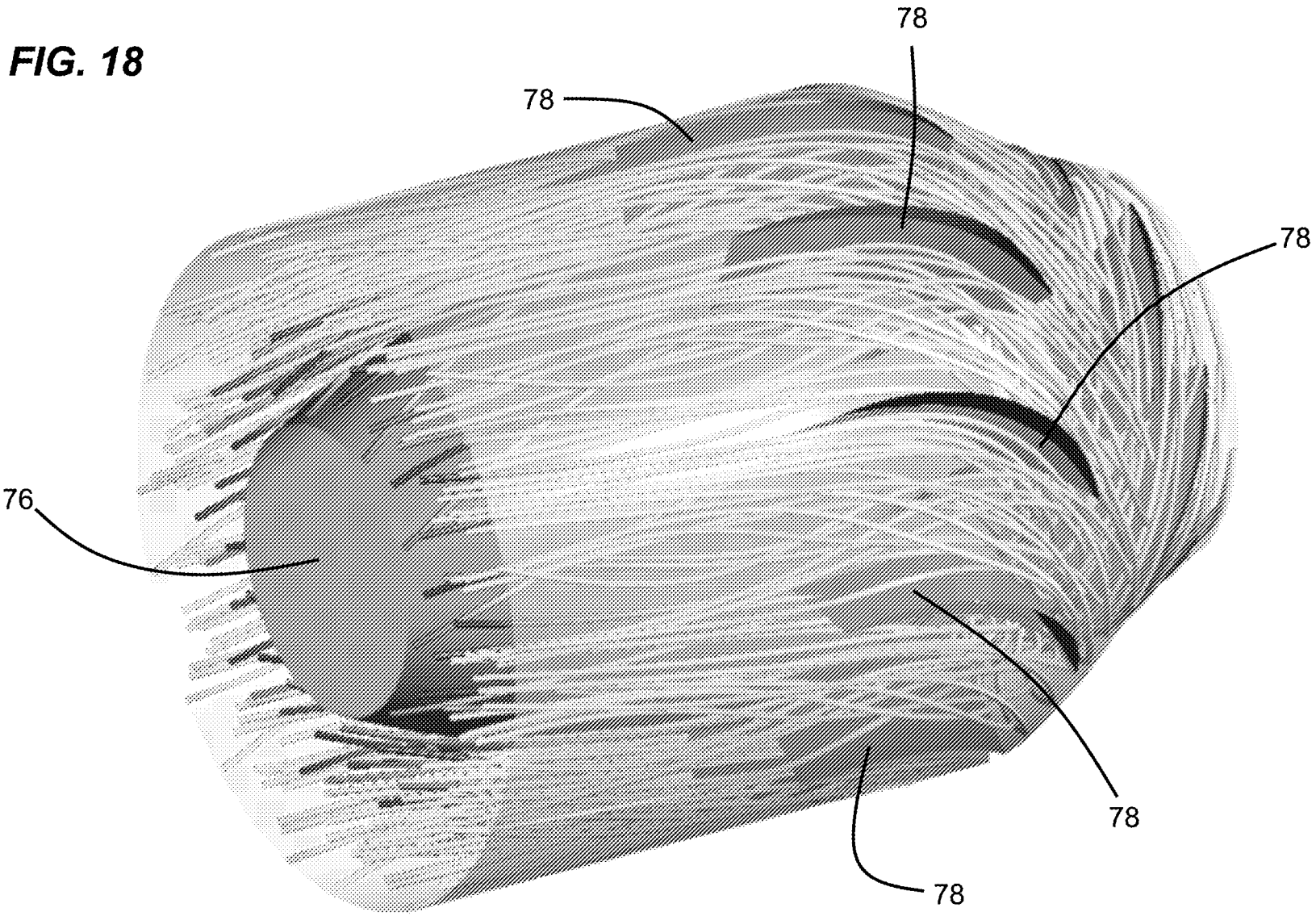
FIG. 18 is a rear isometric view showing air flow through the internal housing of FIG. 13.

FIG. 18 is a rear isometric view showing air flow through the stator blades 78 of the internal housing 70. As shown in FIGS. 5, 6, and 18, the air that enters through the inlet 23 of the bell inlet 44, passes through the fan blades 58 and the wheel cone 62 of the fan wheel 50, passes through the stator blades 78 in the pathway between the outer internal housing 72 and the inner internal housing 76, and then exits through the annulus 21 at the rear of the fan assembly 10. The stator blades 78 straighten the airflow after the airflow passes through the fan wheel 50 and before the airflow exits the annulus 21 at the rear of the fan assembly 10.

In addition to directing airflow through the internal housing 70, the stator blades 78 provide structural support for the inner internal housing 76, which as described above, houses the electric motor 64. The electric motor 64 can be supported within the inner internal housing 76 via an internal support 79, such as a pillow block located in the inner internal housing first part 76*a*, or can be supported by mechanical fasteners at a front face or flange of the electric motor 64. In the example shown, the stator blades 78 connect the inner internal housing 76 to the outer internal housing 72, and the external housing 20 can be attached thereto. In one aspect, the stator blades 78 structurally support the inner internal housing 76 within the outer internal housing 72.

Additionally, the outer internal housing 72, inner internal housing 76, and stator blades 78, are all produced as a single, integral component such that the internal housing 70 is produced as a monolithic part without any welds or other attachment features for joining the stator blades 78 to the inner internal housing 76 and the outer internal housing 72. This can reduce the total number of parts in the fan assembly 10. Advantageously, the internal housing 70 can be produced by 3D printing, which can improve the speed of manufacture and reduce manufacturing costs. In some examples, the internal housing 70 is produced by 3D printing, in accordance with the examples described in U.S. Patent Publication No. 2019/0255611, which has been incorporated by reference in its entirety.

The internal housing 70 can be made from a durable non-ferrous material that provides spark resistance. For example, the internal housing 70 can provide a spark-proof non-ferrous airstream that complies with Type A in 99-0401 standard, Classification for Spark Resistant Construction, by the Air Movement and Control Association International (AMCA), which provides the highest degree of spark resistance. Type A requires all components in the airstream to be constructed of a non-ferrous material, and that minimize contact between stationary and rotating components. Additionally, the non-ferrous materials that are used for constructing the internal housing 70 can reduce the weight of the fan assembly 10.

Additionally, the internal housing 70 is made from a durable material that is inert to many types of hazardous chemicals. For example, the internal housing 70 can be compatible with chemicals including, without limitation, acetic acid, alcohols, butane, chlorine (<1%), formic acid, fuel/oils, heptane, methanol, potassium chloride (<10%), sodium chloride, sodium hydroxide (<20%), sulfuric acid (<10%), and additional types of hazardous chemicals.

In some examples, the internal housing 70 is made from a copolymer material that provides enhanced strength. In other examples, the internal housing 70 is made from a polymer material. In further examples, the internal housing 70 is made from aluminum.

Figure 19:
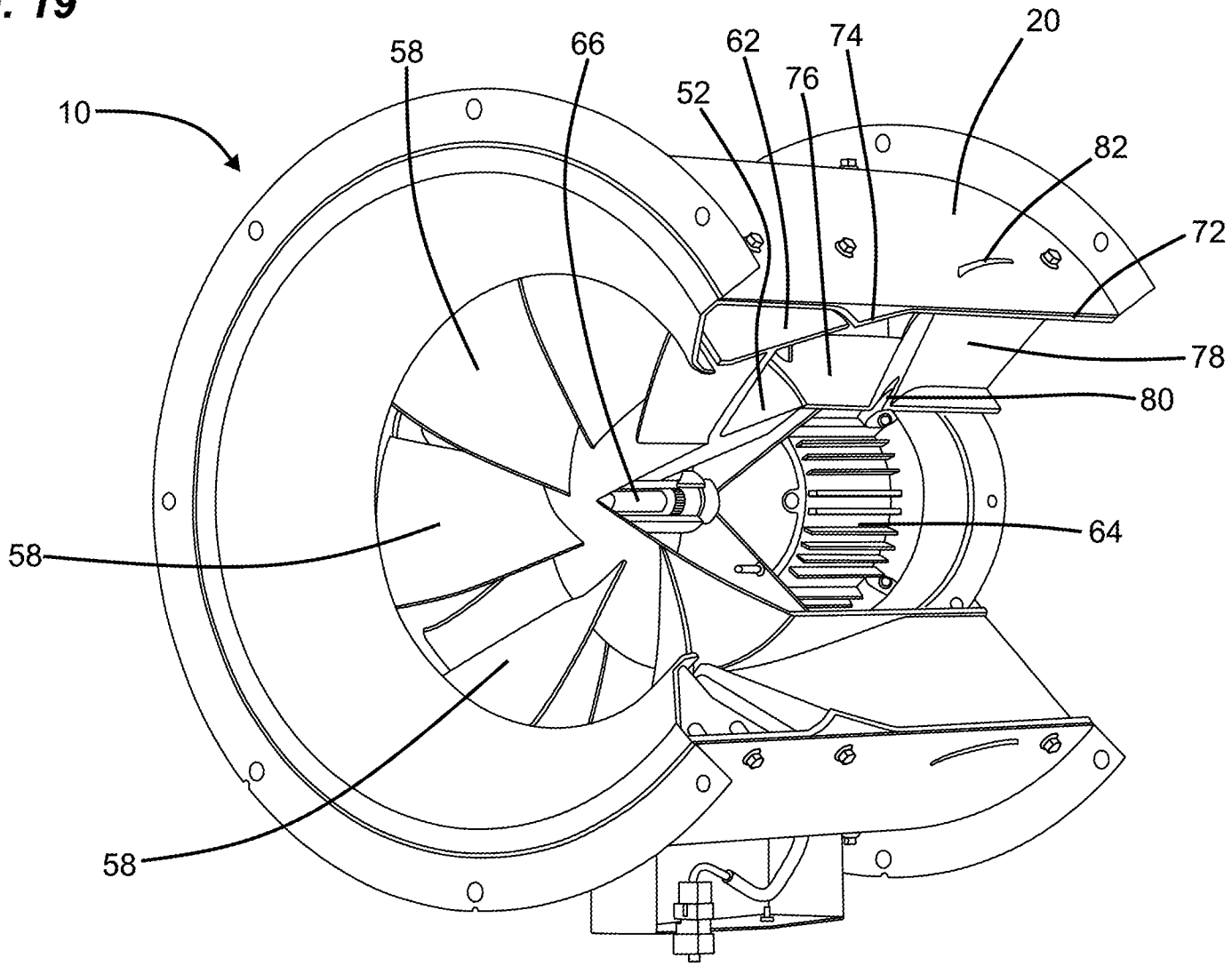
FIG. 19 is a sectional view of another example of a fan assembly.

FIG. 19 is a sectional view of another example of the fan assembly 10. In the example shown in FIG. 19, at least one of the stator blades 78 includes a channel 80 that extends through the stator blade from the internal cavity 75 defined by the inner internal housing 76 to the outer internal housing 72. As shown in FIG. 19, the external housing 20 can include apertures 82 that align with the channels 80 in the stator blades 78 of the internal housing 70. Advantageously, this allows the channels 80 to dissipate heat from the electric motor 64 that is housed inside the internal cavity 75 to outside of the fan assembly 10. The channels 80 can improve the cooling of the electric motor 64 without exposing the electric motor 64 and the air inside the internal cavity 75 to the contaminated airstream that passes through the internal housing 70.

Figure 20:
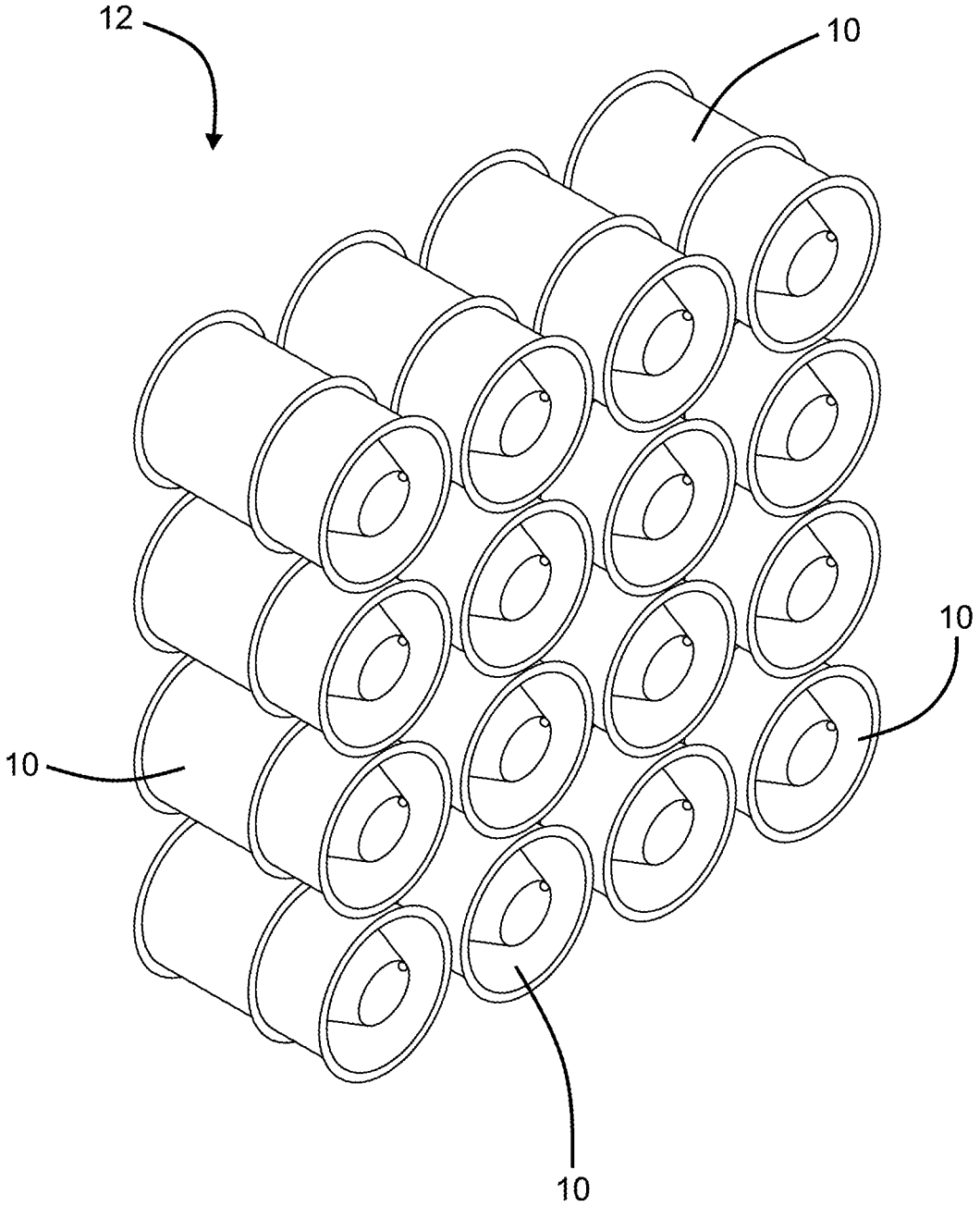
FIG. 20 is an isometric view of an array of fan assemblies.

FIG. 20 is an isometric view of a plurality of fan assemblies 10. As described above, the fan assembly 10 can be mounted in an array 12. In the example shown in FIG. 20, the array 12 includes four columns of fan assemblies and four rows of fan assemblies, such that the array 12 includes sixteen fan assemblies in total. As an illustrative example, the array 12 can be used to cool a large area such as a data center that is used to house computer systems and associated components, including telecommunications systems, that generate heat.

As an illustrative example, the fan assembly 10 can operate under a cubic feet per minute (CFM) range of about 900-24,500 CFM, and can operate under a peak pressure of about to about 7 inches of water gauge (WG). As a further example, the fan assembly 10 can have a maximum sound level of 68 dBA at the inlet 23, and a maximum sound level of 72 dBA at the annulus 21. In some examples, the fan assembly 10 weighs approximately 60 lbs.

As used herein in the following disclosure, the phrases "3D printer system" and "additive manufacturing system" may be used interchangeably. Also, the phrases "printing bed", "printing platform", and "printing table" may also be used interchangeably.

3D Printer System

Embodiments of the following disclosure define a 3D printer system 14 that, due to the totality of the configuration improvements, achieves improved economic and system capabilities, among other advantages. In this example, the 3D printer system 14 is a fused pellet fabrication (FPF)-style printing system. The objects printed by the 3D printer system 14 are made without the use of a mold. This is in contrast to using metal-based pellets in an injection molding scenario via employing a hollow container to catch the molten metal-plastic extruded material, which is a widely known technique.

Figure 21:
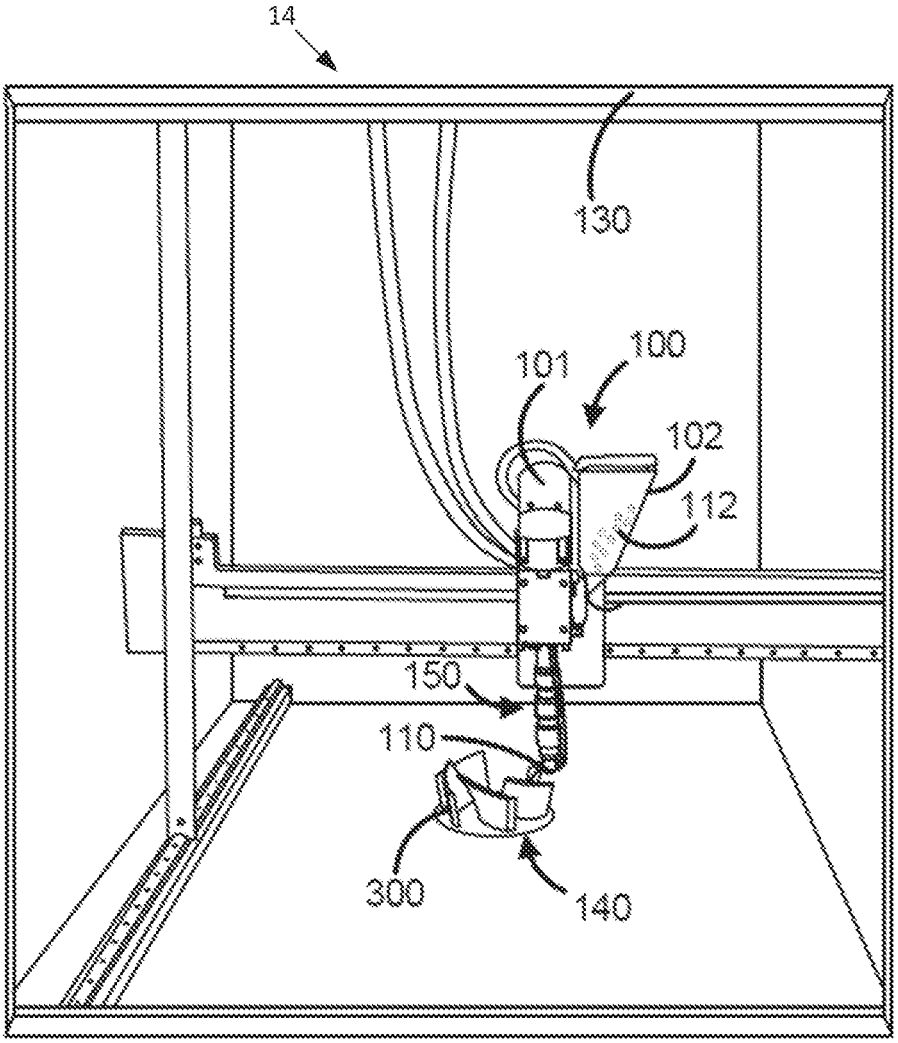
FIG. 21 is a schematic perspective view of an additive manufacturing system that can be used to manufacture the fan assembly of FIG. 1.

FIG. 21 illustrates an example of the 3D printer system 14 having a printing nozzle system 100 in a heated chamber 130. The printing nozzle system 100 may have a motor/gearbox 101, a pellet hopper 102 for feeding pellets 112, and a printing head assembly 150 that includes a nozzle 110. The printing nozzle system 100 deposits product 300 onto a bed 140. Motion control of any components for the printing nozzle system 100 may be effectuated via servo motors controlled by a control system 500 (discussed below). Motion through the nozzle 110 may also be regulated under a number of different methods, such as those disclosed in U.S. Provisional Patent Application No. 62/735,342, which is herein incorporated by reference in its entirety.

Figure 22:
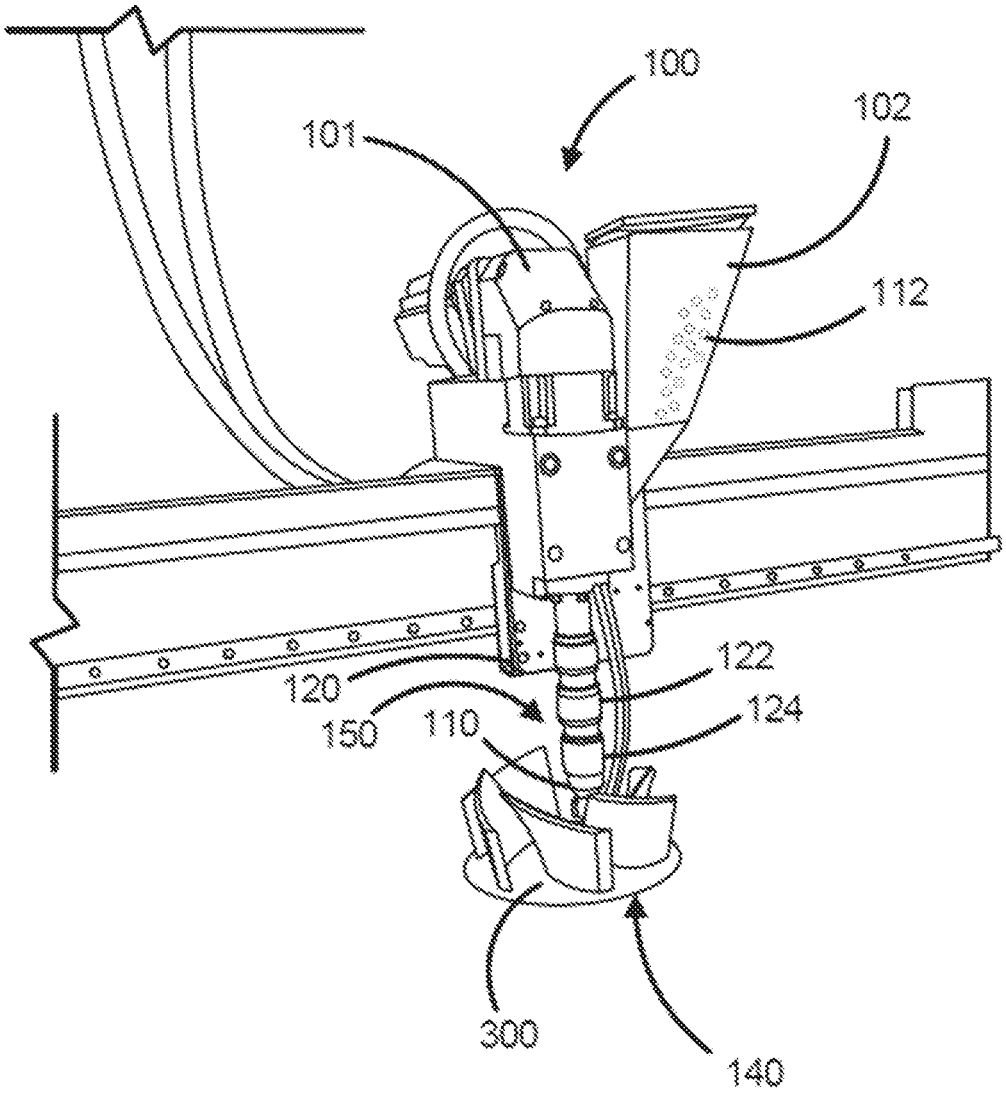
FIG. 22 is another schematic perspective view of the additive manufacturing system shown in FIG. 21.
Figure 23:
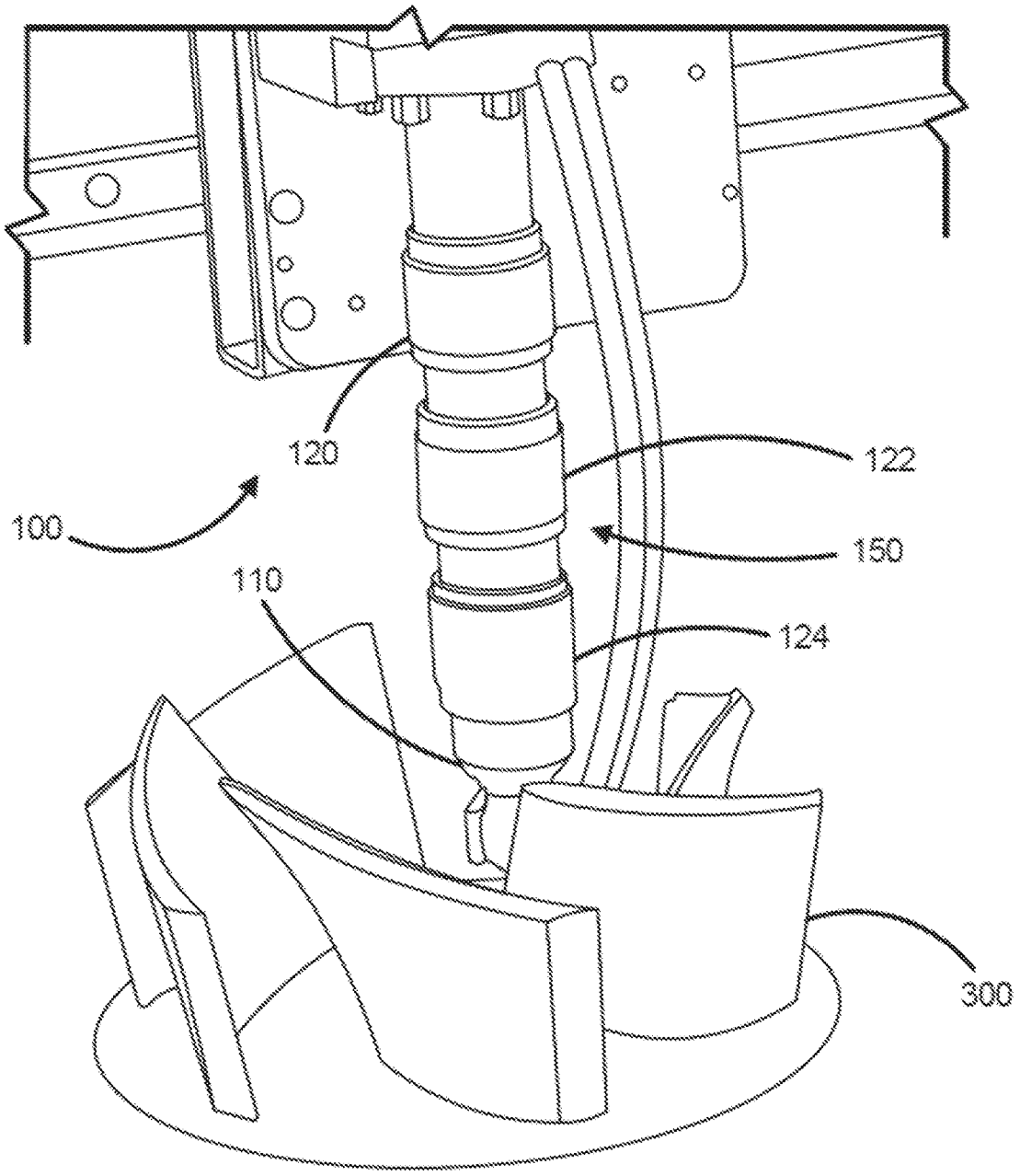
FIG. 23 is a perspective view of the additive manufacturing system shown in FIG. 21, including a printing head assembly, and a partly finished product.

FIG. 22 is a magnified view of the printing nozzle system 100. Heaters 120, 122, 124 for the printing head assembly 150 are visible. FIG. 23 is a magnified view of the printing head assembly 150. The heaters 120, 122, 124 of the printing head assembly 150 are visible, as are the contours of the product 300 deposited on the bed 140.

As shown in FIGS. 21-23, the printing nozzle system 100 for the 3D printer system 14 may be enclosed within the heated chamber 130 for depositing extruded material. The temperature of the heated chamber 130 may vary from 0° C. to 85° C. The product 300 is deposited onto the bed 140. The temperature of the bed 140 may vary from 0° C. to 130° C.

Figure 24:
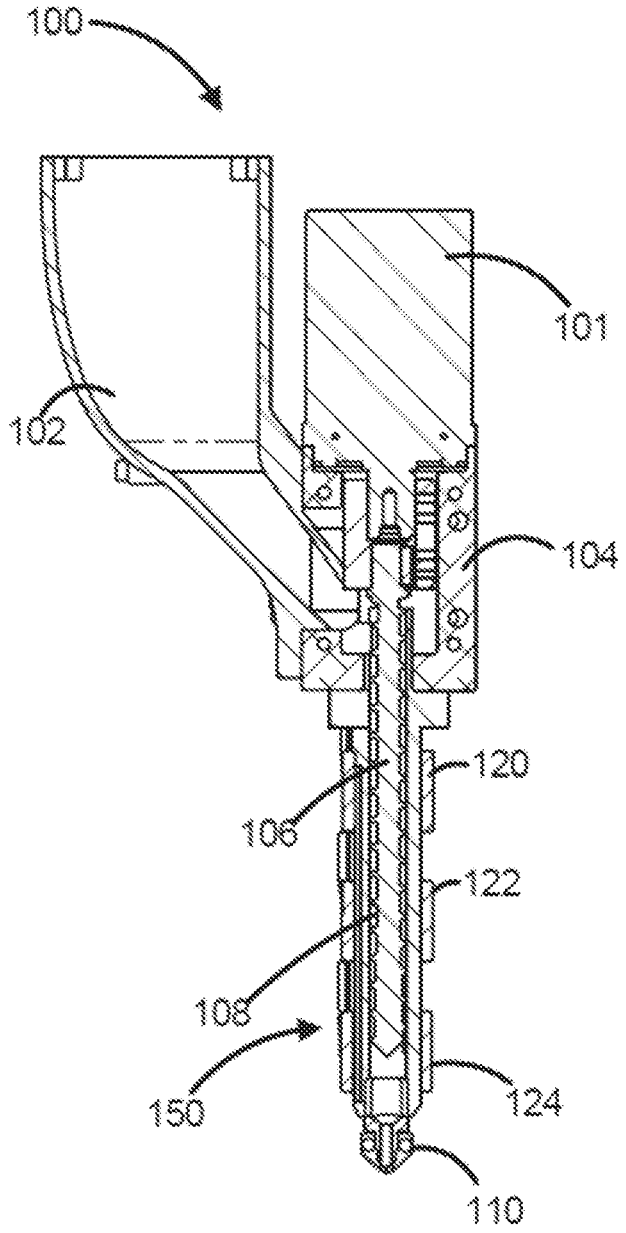
FIG. 24 is a cross-sectional side view of a printing nozzle system of the additive manufacturing system shown in FIG. 21.

Referring to FIG. 24, the printing nozzle system 100 includes the motor/gearbox 101, the pellet hopper 102, an extruder body 104, a turnable screw 106 for extruding the pellets, a barrel 108 for housing the turnable screw 106, and the nozzle 110. Along the barrel 108, there may be one or more heaters that can provide heat to the barrel 108. By non-limiting example, FIG. 4 illustrates an embodiment where there are three heaters 120, 122, and 124.

In operation, a screw extruder, such as the turnable screw 106, is a hardware mechanism within the printing nozzle system 100 that acts as an auger that causes the pellets 112 to travel down the length of the turnable screw 106 (along the threads of the turnable screw 106 during the rotation of the turnable screw 106) towards the end of the nozzle 110. As the pellets 112 travel down the length of the turnable screw 106, the pellets are melted via shear forces developed by rotation of the turnable screw 106 against the pellets and by at least one heater (e.g., at least one of the heaters 120, 122, or 124), until the pellets 112 are liquid as they exit the nozzle 110. Examples of the pellets 112 that may be used include 316L stainless steel MIM pellets, or 17-4 stainless steel pellets. The pellets 112 may also be formed from polymer and copolymer materials, and can be composite materials including more than one material.

Figure 25:
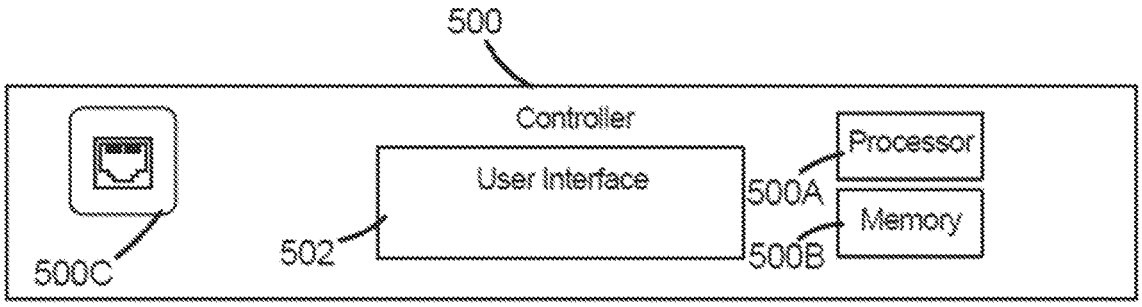
FIG. 25 is a schematic illustration of an example of a control system of the additive manufacturing system shown in FIG. 21.

FIG. 25 is a schematic of the control system 500 of the printing nozzle system 100. The control system 500 is discussed in greater detail later below.

In one example, the product 300 is formed from a pellet feedstock that is fed into the printing nozzle system 100 through the pellet hopper 102. The pellet feedstock can be a mixture of metal powder as a primary material and various binder materials that are integral and homogenous with the primary material. In some examples, the pellets are a non-metal material, such as polymer/polymeric-based materials.

Where metal-based materials are used, the output of the printing nozzle system 100 yields a three-dimensional "green" printed part. The various binder materials are then removed from the primary material in subsequent phases where the printed part transitions from a "green" state to a "brown" state through a de-binding and sintering processes, which remove the binder materials, allowing the primary material to collapse upon itself, yielding a three-dimensional solid metal part exhibiting material properties at or near wrought material strength.

In view of the foregoing, the use of the term "green" means that the material has been printed but has not undergone further processing to remove binding materials. By using the term "brown", it is understood that the printed material has been printed and undergone a de-binding process, but has not received any additional heat treatment or other processing. Referring to a material as "finished" means that the printed material has undergone printing, de-binding, and sintering heat treatment (and any other treatments) to fully densify the printed material.

Embodiments of the present disclosure also describe a system that is capable of allowing the FPF process to print most common polymer-based pellet-form feedstocks at a significant reduction in material costs. The elimination of the common FFF filament feedstock also allows for a significant reduction in polymer material cost.

Embodiments of the present disclosure further describe the 3D printer system 14 as being capable of printing at a lower cost and at a much faster rate than FFF-style printers due to the elimination of the filament and the addition of expanded extrusion zones and material feed mechanisms. This is accomplished while maintaining part surface smoothness associated with much slower print speed protocols.

In addition to the ability to 3D print and post-process material to yield a solid or near-solid metal part, embodiments of the present disclosure are capable of printing 3D parts that are:

(1) relatively large (for example, 3 feet×3 feet×2 feet, or more), although smaller parts are contemplated as well; (2) metal or polymer/composites; (3) at economic levels that are lower than parts currently made using more traditional metal processing techniques; and (4) capable of producing solid metal parts or products that are printed to take advantage of mass-customization which is another significant advancement in the state-of-the-art.

The extrusion process can print a continuous stream at a speed of about 1,000 mm/minute to about 10,000 mm/minute. These ranges may vary depending upon the MIM material that is extruded. In certain examples, printing speeds may vary from about 1,500 mm/minute to about 3,100 mm/minute.

Although embodiments are described above with reference to a 3D printer that uses a nozzle system comprising a screw-type extruder, other types of extruders (such as non-screw—type extruders) may alternatively be employed, in any of the configurations and embodiments described above. For example, a ram extruder may be used instead of a screw.

Control System

Referring to FIG. 25, the printing nozzle system 100 may also include a control system 500. The control system 500 is schematically shown as including a processor 500A and a non-transient storage medium or memory 500B, such as RAM, flash drive or a hard drive. A jack interface 500C is also shown. The memory 500B is for storing executable code, operating parameters, and inputs from an operator user interface 502 while the processor 500A is for executing the code. Examples of the memory 500B include computer readable media, which may include any available media that can be accessed by the processor 500A. By way of example, computer readable media can include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks, or other optical storage, or any other medium that can be used to store information for access by the processor 500A.

Computer readable communication media embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. For example, computer readable communication media can include wired media such as a wired network or direct-wired connection, and wireless media such as acoustic, radio frequency, infrared, and other wireless media. Combinations of any of the above are also included within the scope of computer readable media.

The control system 500 can also have a number of inputs/outputs that may be used for operating the printing nozzle system 100. The printing head assembly 150 may include pressure sensors that provide inputs to the control system 500. The printing head assembly 150 can also include inputs and outputs, such as an output to control the operation of the actuator for the turnable screw 106. The control system 500 can also include additional inputs and outputs for desirable operation of the printing nozzle system 100 such as motion control servo motors.

Selection and Manufacturing Process

Figure 26:
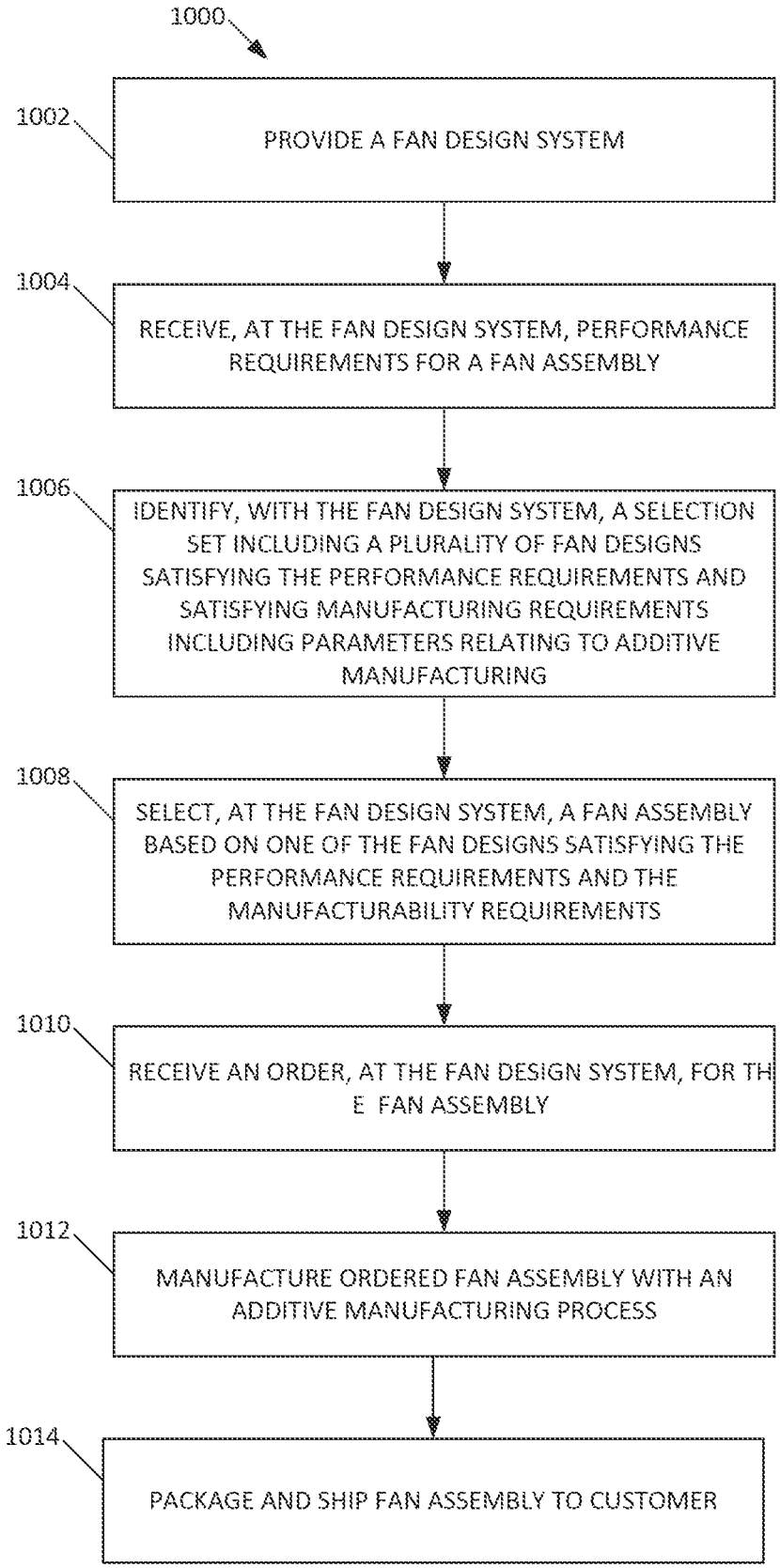
FIG. 26 illustrates a process for selecting and producing a fan wheel by using the additive manufacturing system shown in FIG. 21.

With reference to FIG. 26, an example of a process 1000 for customizing the manufacture of one or more components of the fan assembly 10 is shown. In one aspect, the process 1000 can be implemented by the 3D printer system 14, described above.

The process 1000 includes a step 1002 of providing a fan design system. The fan design system can be provided with a graphic user interface (GUI) for enabling a user or customer to input information into the system. The fan design system can be a stand-alone, packaged program installed on a local computer, can be housed on a remote server that can be accessed via a web browser, or can be a combination of both. In one example, the fan design system includes a multiple-objective optimization engine that considers multiple objective functions simultaneously to develop a Pareto front including a plurality of candidate fan designs.

The process 1000 includes a step 1004 of receiving, at the fan design system, performance requirements for a fan assembly, such as the fan assembly 10 shown in FIG. 1. In one example, a customer or user enters the performance requirements into the fan design system via the GUI. Non-limiting examples of performance requirements for a fan assembly can include: fan type (e.g., mixed flow, centrifugal, axial, and the like); application type (e.g., laboratory exhaust, general use, and the like); drive type (e.g., belt drive, direct drive, variable frequency drive, and the like); discharge type (e.g., top, side, etc.); mounting type and location (e.g., roof, wall, hanging, interior, exterior); system type (e.g., variable volume, constant volume, etc.); fan size; fan nominal, minimum, and maximum operating points including airflow volume, external static pressure, efficiency, and/or brake horsepower; fan operating conditions including ambient air temperature, airstream temperature, elevation; fan material type; supply voltage and/or power type; and anticipated operating costs. Many other examples of performance requirements that could be used to select a satisfactory fan assembly are contemplated.

Once the fan requirements are received by the fan design system, the process 1000 includes a step 1006 of identifying, with fan design system, a selection set including a plurality of fan designs satisfying the performance requirements received at step 1004. In one example, primary performance requirements are flow path, back pressure, and airflow rate while secondary performance requirements are fan size limitations, environmental conditions, industry standards, and government regulations. At step 1006, the fan design system can also be configured to determine which of the fan designs in the selection set satisfy manufacturing requirements as well. Non-limiting examples of manufacturing requirements for a fan assembly can include: whether the fan assembly can be manufactured with an additive manufacturing process; material cost; manufacturing cost; manufacturing time; sales price; and fan wheel structural strength. The evaluation of manufacturing requirements can be performed such that the selection set is initially created based on the performance requirements and is subsequently reduced based on selecting the fan designs which also satisfy the manufacturing requirements. Alternatively, this step can also be performed such that each individual fan design is evaluated for satisfying the manufacturing requirements such that the initial selection set includes only those fan designs satisfying both the performance and manufacturing requirements.

Next, the process 1000 includes a step 1008 of selecting, at the fan design system, one of the fan designs satisfying the performance and manufacturing requirements. As stated previously, the fan design system can be configured to consider multiple objective functions simultaneously to develop a Pareto front including a plurality of candidate fan designs.

The multiple objective functions can include parameters relating to the performance requirements, parameters relating to the manufacturing requirements, and/or other parameters. In one example, the fan design system can be configured to rank the fan designs in the selection set based on the multiple objective functions analysis. Accordingly, step 1008 can be performed automatically by the fan design system to select the highest ranked fan design.

The multiple objective functions analysis can include parameters such as the maximization of fan efficiency, minimization of manufacturing costs and time, maximization of fan strength, and minimization of material used to construct fan. In one example, the fan design system can provide a ranked or unranked selection set to the user or customer with fan assembly designs satisfying the performance and manufacturing requirements such that the user or customer can manually select a fan assembly. In one example, the fan assembly designs are ranked according to the sales price of the fan assembly.

Once the fan assembly is ordered, the process 1000 includes a step 1012 of manufacturing the fan wheel and/or the inner housing of the fan assembly using the 3D printer system 14 by generating a printing code from the fan design order and sending the printing code to the control system 500.

Next, the process 1000 can include a step 1014 of assembling the manufactured fan wheel and/or inner housing into the fan assembly 10, which can then be packaged and shipped to the user or customer.

Next, the process 1000 can include a step 1014 of assembling the manufactured fan wheel into the fan assembly 10, which can then be packaged and shipped to the user or customer.

Fan Wheel Design and Construction

Referring to FIGS. 27-44, illustrations of exemplary fan wheel constructions and features are shown. FIGS. 27-30 show examples of a fan wheel 400 that can be constructed using the 3D printer system 14 and the process 1000. In general terms, each of the examples of the fan wheel 400 includes a base 402 from which a plurality of blades 404 extend.

The base 402 may be printed to have a frustoconical shape or a truncated dome shape and may also be printed to have a central aperture to receive a shaft, such as the motor shaft 66. In some examples, the base 402 can be printed to include a central shaft. In one example, the base 402 is printed such that the base is hollow and to optionally include a support structure within and/or along the bottom plane of the base 402 to give the base 402 additional structural strength. In some examples, the support structure is a lattice-type structure with a honeycomb pattern. The support structure can be formed as a planar structure with a constant or limited thickness, as shown, or can be printed throughout the entire hollow portion of the base such that the support structure fills the internal cavity defined by the base 402.

Figure 27:
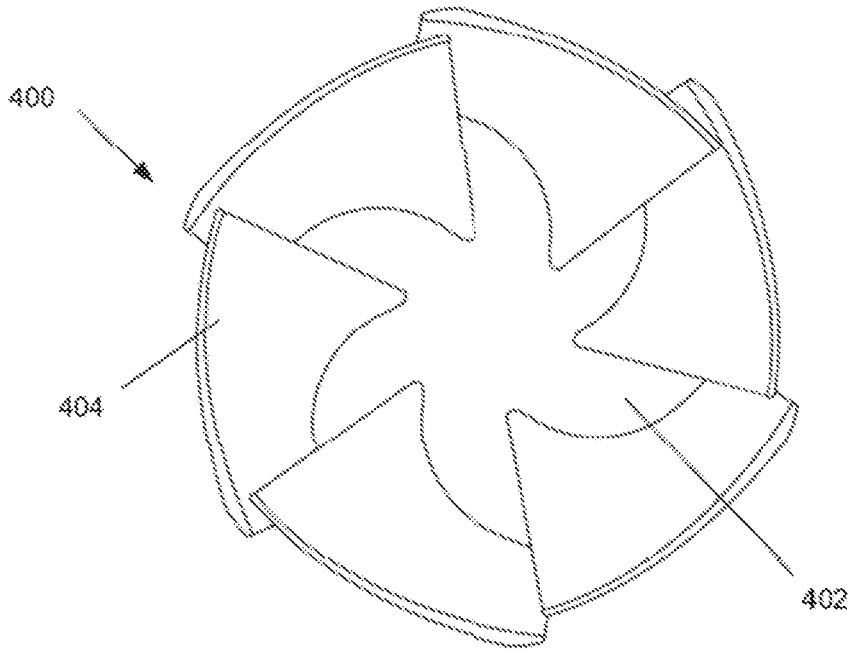
FIG. 27 is a front view of an example of a fan wheel for the fan assembly of FIG. 1 produced by the additive manufacturing system shown in FIG. 21.
Figure 28:
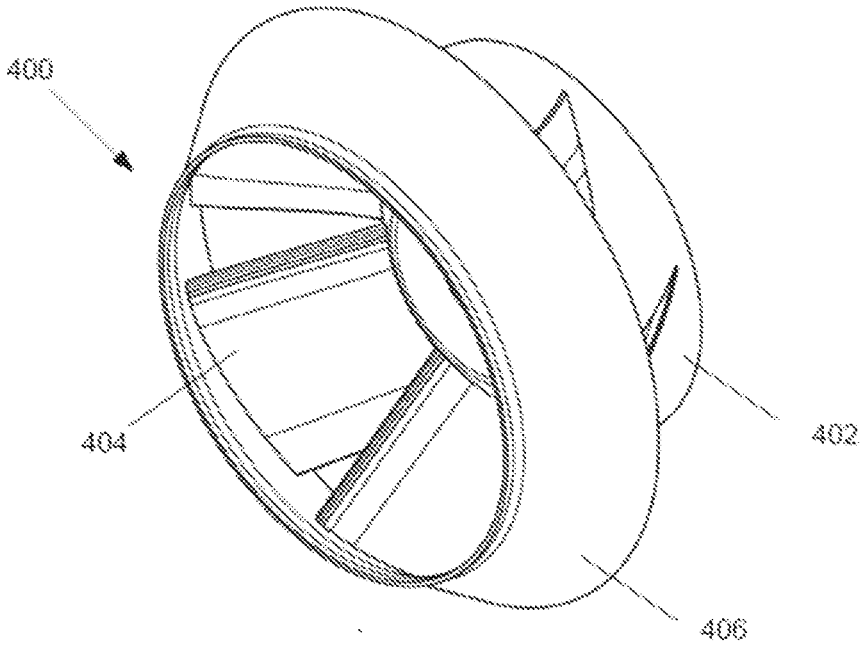
FIG. 28 is a front perspective view of an example of a mixed-flow type of fan wheel for the fan assembly of FIG. 1 produced by the additive manufacturing system shown in FIG. 21.

The 3D printer system 14 and the process 1000 can be utilized to generate a number of different types of objects, fan wheels, and housings, such as for manufacturing the fan assembly 10 shown in FIG. 1. For example, FIGS. 27 and 28 show mixed-flow examples of the fan wheel 400, each having a base 402 and a plurality of blades 404. In the example shown at FIG. 28, the fan wheel 400 also includes a wheel cone 406. In one aspect, the base 402 is printed to have a frustoconical shape and the blades 404 are printed to have an airfoil shape.

Figure 29:
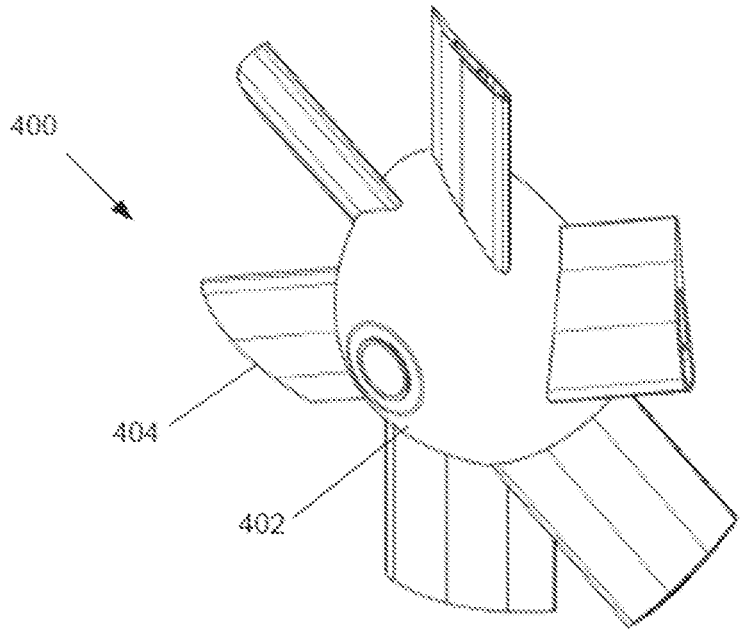
FIG. 29 is a front perspective view of an example of an axial type of fan wheel for the fan assembly of FIG. 1 produced by the additive manufacturing system shown in FIG. 21.
Figure 30:
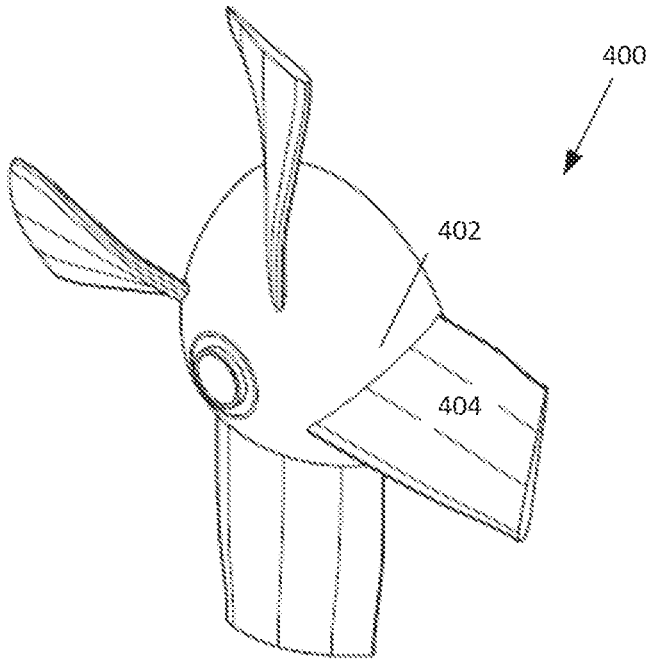
FIG. 30 is a front perspective view of another example of an axial type of fan wheel for the fan assembly of FIG. 1 produced by the additive manufacturing system shown in FIG. 21.

Another example of a fan wheel 400 is shown at FIG. 29. In this example, a base 402 is printed to have a dome-shape with blades 404 that are airfoil shaped to provide an axial flow type example for the fan wheel 400. FIG. 30 shows an example similar to FIG. 29, but where the blades are printed to have a twist along their length. Each of these examples of the fan wheel 400 shown in FIGS. 27-30 are printed to have a central aperture to receive the motor shaft 66 and are provided with a base 402 with or without a support structure, as previously described.

Additional examples of the fan wheel 400 may also be printed using the 3D printer system 14 and the process 1000, such as centrifugal-type fans. Although the examples of the fan wheel 400 are described as examples of printed objects, the present disclosure should not be taken to be limited to these particular implementations.

Figure 31:
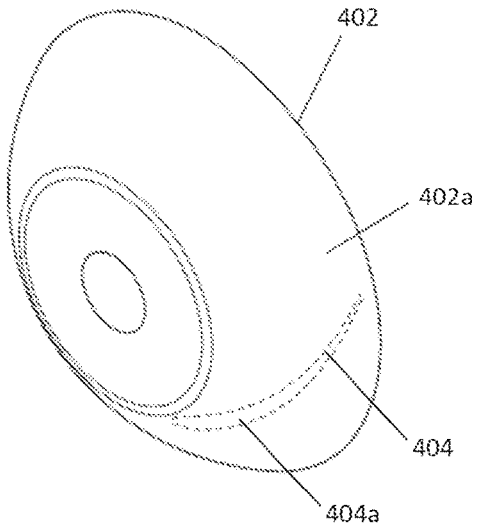
FIG. 31 is a front perspective view of an example of a partially printed fan wheel for the fan assembly of FIG. 1 produced by the additive manufacturing system shown in FIG. 21.
Figure 32:
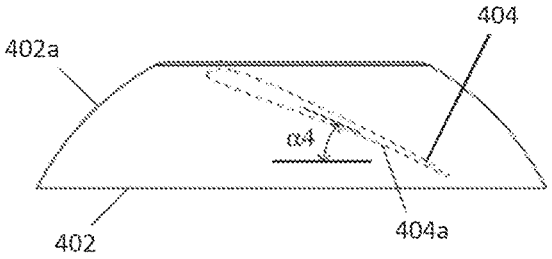
FIG. 32 is a side view of the partially printed fan wheel shown in FIG. 31.
Figure 33:
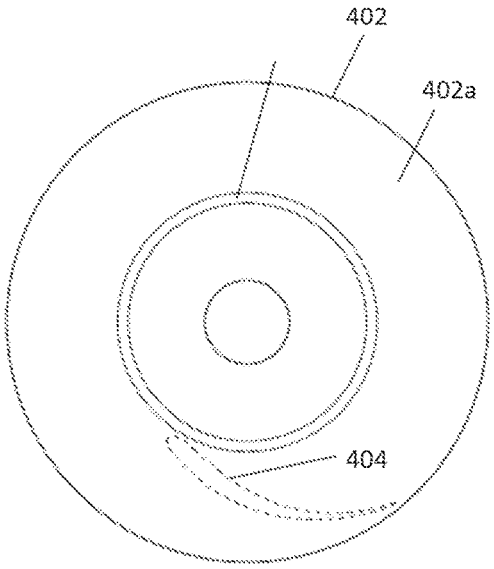
FIG. 33 is a top view of the partially printed fan wheel shown in FIG. 31.
Figure 34:
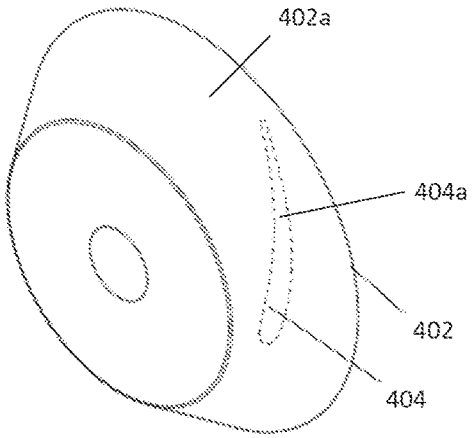
FIG. 34 is a front perspective view of a partially printed fan wheel for the fan assembly of FIG. 1 produced by the additive manufacturing system shown in FIG. 21.
Figure 35:
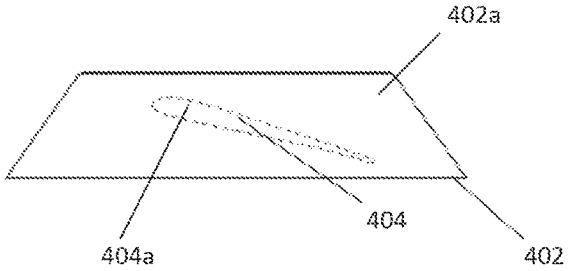
FIG. 35 is a side view of the partially printed fan wheel shown in FIG. 34.
Figure 36:
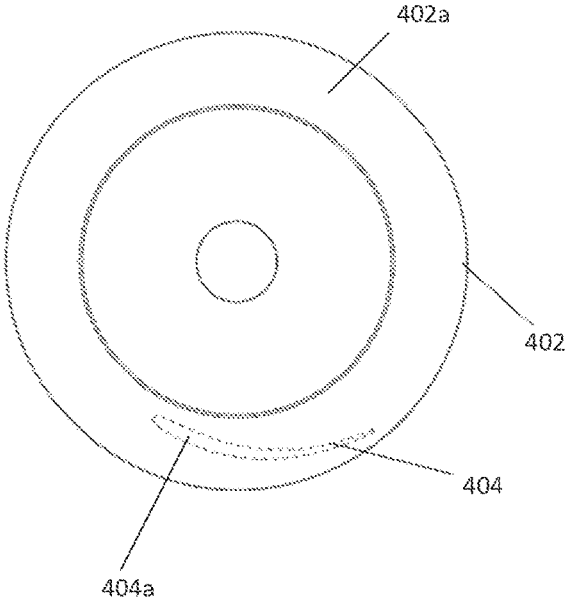
FIG. 36 is a top view of the partially printed fan wheel shown in FIG. 34.

With reference to FIGS. 31-36, examples of the base 402 that are partially printed are shown. In FIGS. 31-33, the examples of the base 402 are shown as having a partial dome shape. In FIGS. 34-36, the examples of the base 402 are shown as having a frustoconical shape. In each of the examples shown in FIGS. 31-36, the base 402 is provided with an outer wall **402*a* defining an outer surface 402*b* (shown in FIGS. 38 and 39**).

Figure 37:
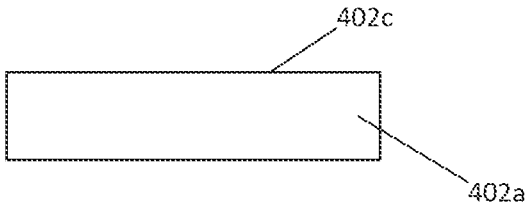
FIGS. 37-39 show an example of a printing order for printing any of the fan wheels shown in FIGS. 27-36.
Figure 38:
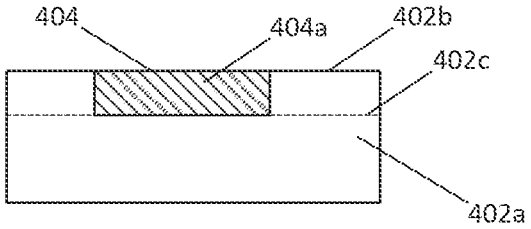
Figure 39:
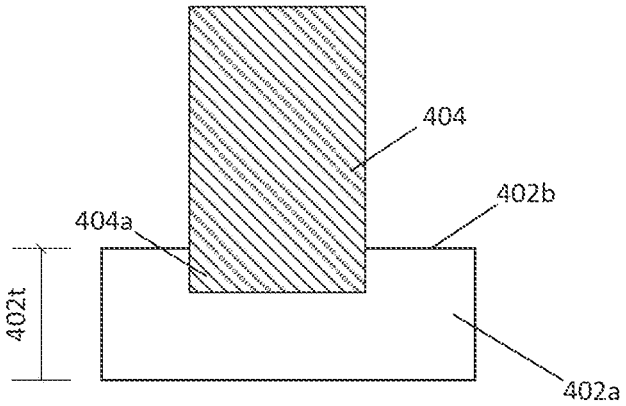

As shown in the examples provided in FIGS. 37-39, the outer wall **402*a* defines a thickness 402*t*. In some examples, the thickness 402*t* is about ⅛ inch for polymers. In contrast to a typical additive manufacturing approach in which the blades 404 would be printed as soon as the outer wall 402*a* reaches the outer surface 402*b* such that the blades 404 are essentially printed onto the outer surface 402*b*, the 3D printer system 14 can start to print the blades 404 before the outer wall 402*a* reaches the outer surface 402*b***.

For example, as shown at FIG. 37, the 3D printer system 14 begins printing the outer wall **402*a* to reach an intermediate point 402*c*, and then the 3D printer system 14 begins to print the blade 404 within the outer wall 402*a*, as shown in FIG. 38. In one aspect, the shape of the blade 404 is printed within the outer wall 402*a* with the same general printing pattern as followed for the portion of the blade 404 extending beyond the base 402. As shown at FIG. 38, the simultaneous printing of the outer wall 402***a* and the blade 404 continues until the outer wall 402*a* reaches the outer surface 402*b*.

In another embodiment, the 3D printer system 14 can first print the blade 404, and then proceed to print the outer wall 402*a* together with the root section of the blade 404. Thus, the 3D printer system 14 can print the fan wheel 400 in either a bottom-up direction (i.e., print the outer wall 402*a* and then the root section of the blade 404 together with the outer wall 402*a*), or in a top-down direction (i.e., print the blade 404 and then print the outer wall 402*a* together with the root section of the blade 404).

FIGS. 31-36 show an example (in phantom lines) of a shape and orientation of a blade 404 printed into the outer wall 402*a* of the base 402. Once the outer wall 402*a* reaches the outer surface 402*b*, the blade 404 is printed from that point to completion, as shown in the cross-sectional view provided in FIG. 39. With this approach, a root portion 404*a* of the blades 404 having the same printing pattern and shape as the remainder of the blade 404, extends beyond the outer surface 402*b* of the base 402, while also residing within the base 402.

The foregoing process significantly increases the rotational strength of the fan wheel 400 allowing for a significantly higher maximum rotational speed (e.g., revolutions per minute (rpm)) that can be obtained before failure of the fan wheel 400. It is noted that the examples in FIGS. 31-39 are provided to show the general concept of printing the blades 404 with the printing pattern of the blades 404 within the material thickness of the outer wall 402*a*, and are not intended to illustrate any physical point of an actual additive manufacturing process, in which various portions of the base 402 and the blades 404 are being printed according to a print order defined by a location of the printing head assembly 150 along the z-axis.

Figure 40:
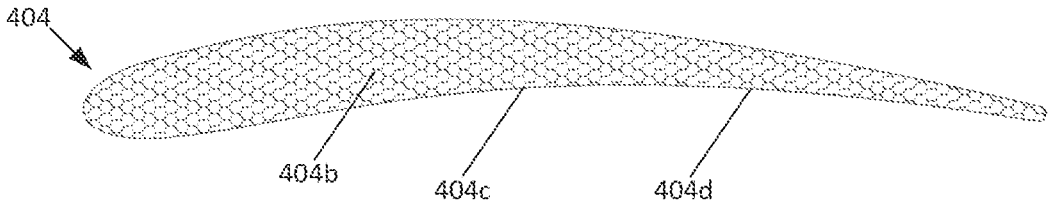
FIGS. 40-44 show cross-sectional views of exemplary fan blades suitable for use with any of the fan wheels shown at FIGS. 27-36, wherein the fan blade is produced by the additive manufacturing system shown in FIG. 21.
Figure 41:
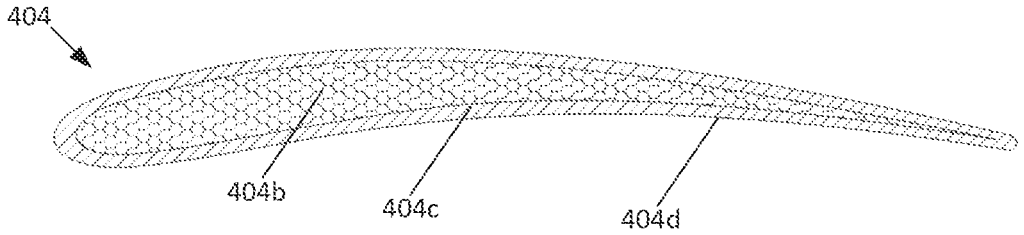

Referring to the cross-sectional views shown in FIGS. 40-44, various configurations of the blades 404 for the fan wheels 400 are provided. While the blades 404 can be printed as entirely solid structures or as hollow structures with or without internal support structures, many other configurations are possible. For example, FIG. 40 shows a configuration in which the blade 404 is printed with an internal lattice structure 404*b* surrounded by an outer wall 404*c* defining an outer surface 404*d* of the blade 404. FIG. 41 shows a similar configuration, but where the outer wall 404*c* has a greater relative thickness in comparison to the example shown at FIG. 40.

Figure 42:
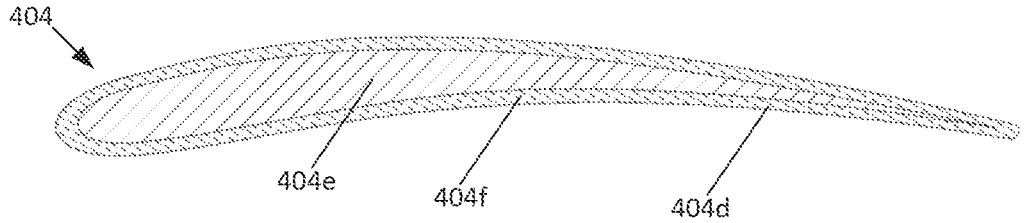
Figure 43:
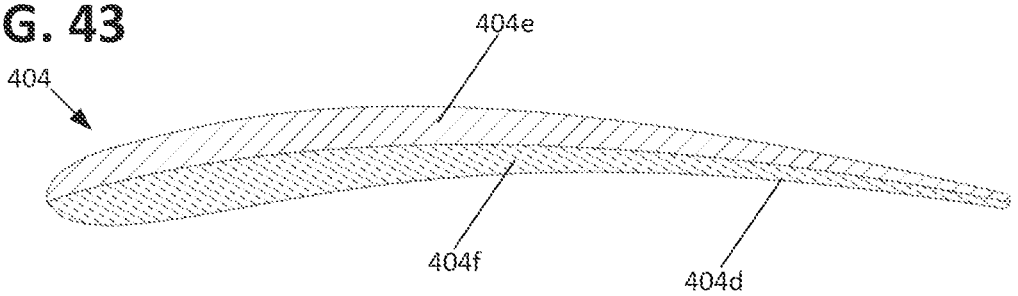

FIGS. 42 and 43 show examples of the blade 404 that is entirely solid, but where the blade 404 is printed from two different materials with a first portion 404*e* of the blade 404 being printed from a first material and a second portion 404*f* being printed from a second material different from the first material. In the example shown at FIG. 42, the first and second portions 404*e*, 404*f* are arranged such that the first portion 404*e* defines an inner portion of the blade 404 and the second portion 404*f* defines an outer portion and outer surface 404*d* of the blade 404. In the example shown at FIG. 43, the first and second portions 404*e*, 404*f* extend the entire length or chord of the blade 404 such that the first portion 404*e* defines an upper surface of the blade 404 and the second portion 404*f* defines a lower surface of the blade 404. The blade 404 can also be configured such that the first portion 404*e* defines a leading edge or nose portion of the blade and the second portion 404*f* defines a trailing edge or tail portion of the blade.

Figure 44:
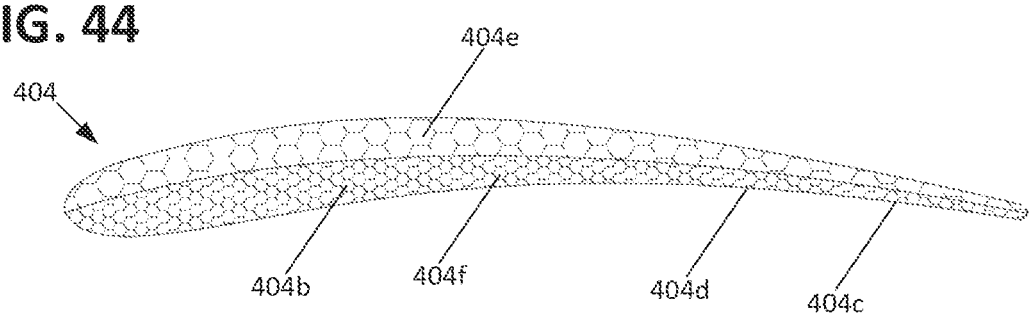
Figure 45:
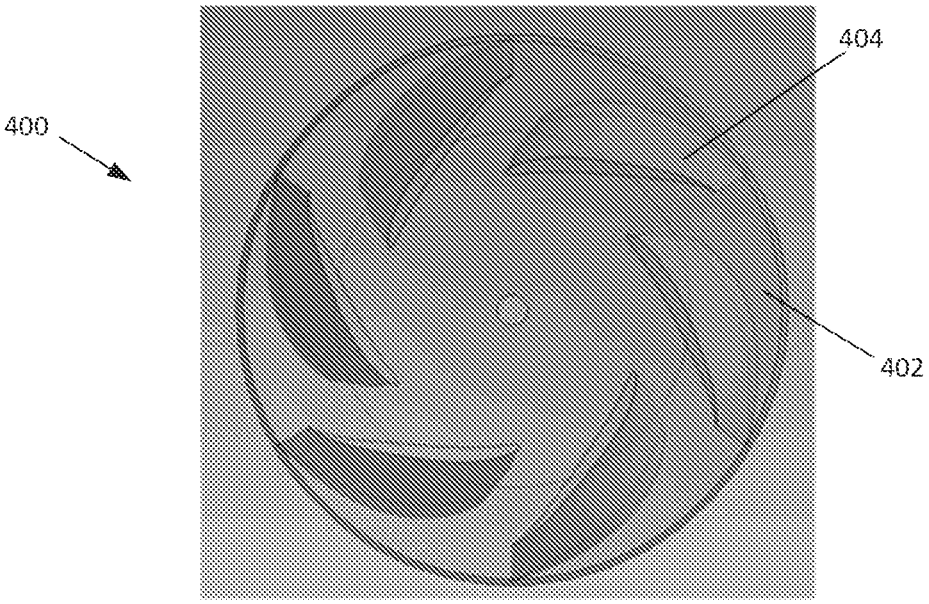
FIGS. 45-49 show example geometries for fan wheels produced by additive manufacturing system shown in FIG. 21, the fan wheels having features usable with any of the fan wheels shown at FIGS. 27-36.
Figure 46:
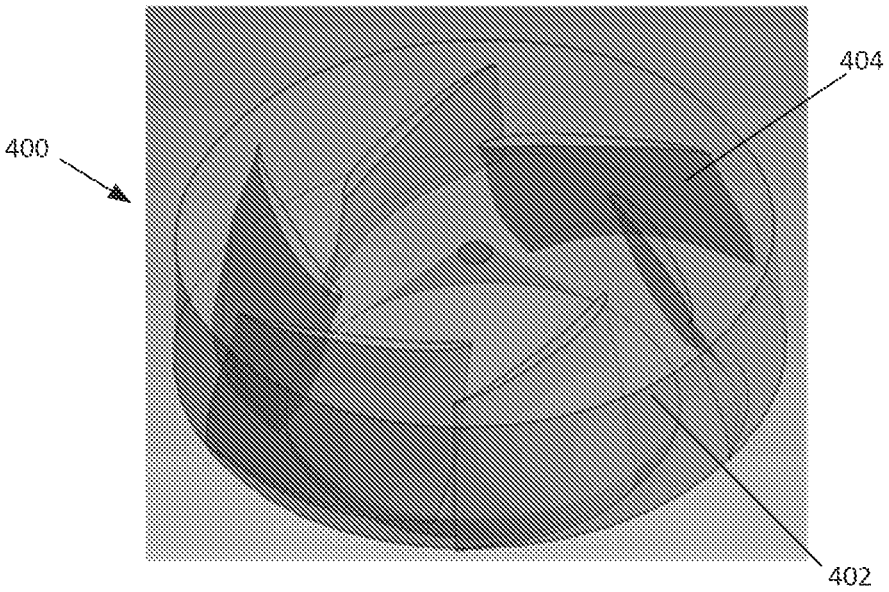
Figure 47:
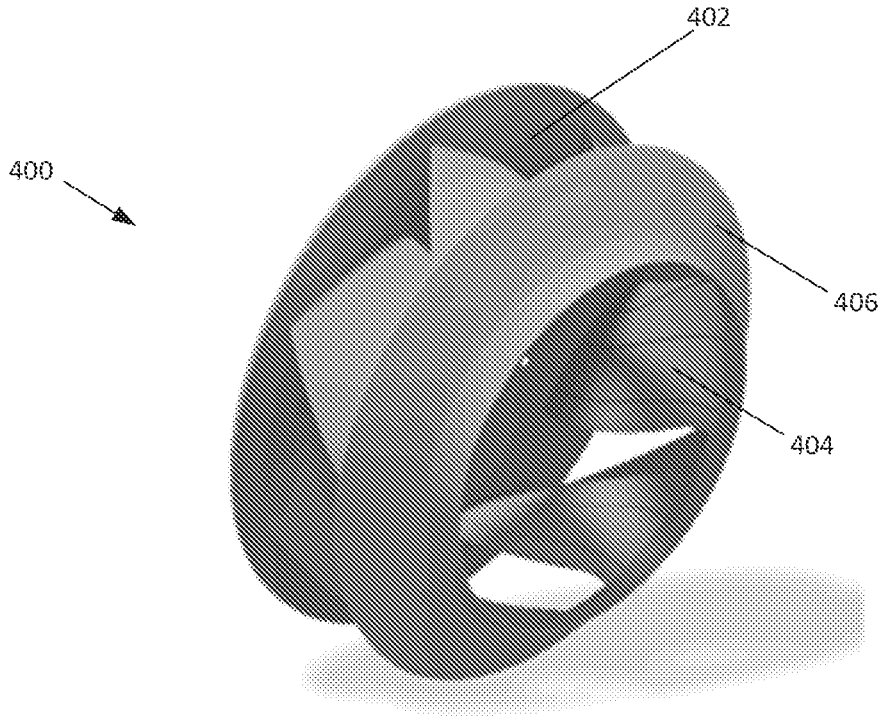
Figure 48:
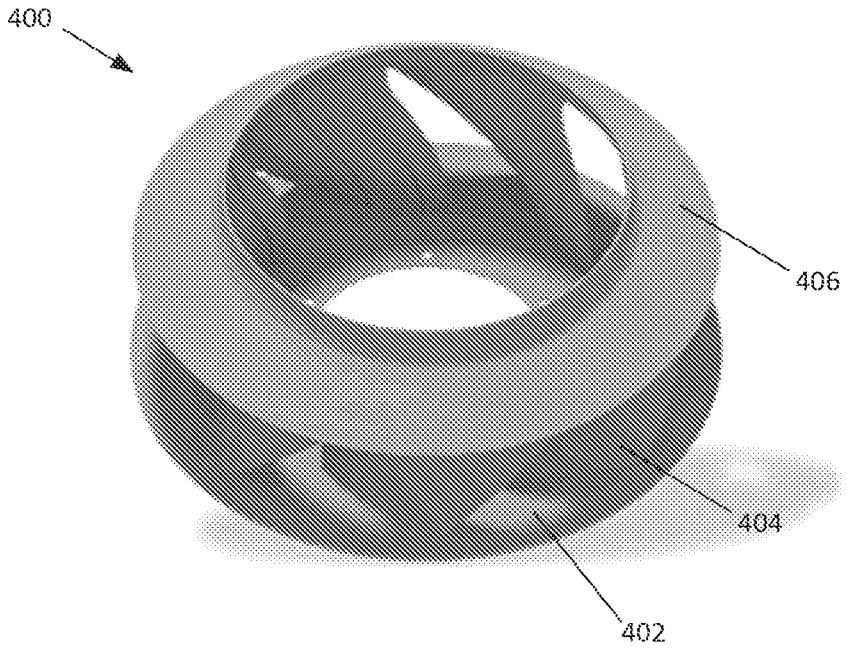

FIG. 44 shows a configuration similar to the one shown in FIG. 43, but where the first and second portions 404*e*, 404*f* are lattice structures and are surrounded by the outer wall 404*c* defining the outer surface 404*d*. Additional configurations are also possible.

With reference to FIGS. 45-49, example geometries for the blades 404 producible in accordance with the concepts described herein are shown. These geometries and features can be incorporated into any of the examples of the fan wheel 400 shown at FIGS. 27-36.

Figures 49, 50:
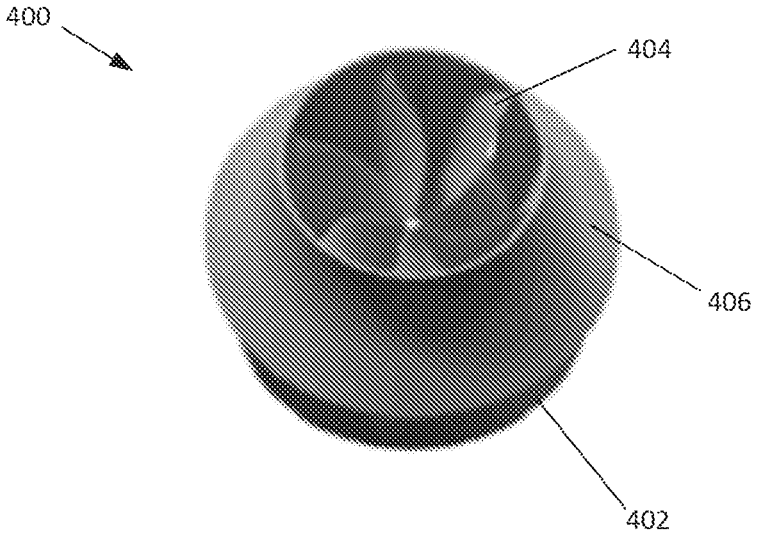
FIG. 50 is a graphical depiction showing a comparison in performance between the fan wheels shown in FIGS. 45-49 and a standard fan wheel.

With reference to FIG. 49, an example of the fan wheel 400 is shown having the blades 404 form a "tulip shape" that converge or nearly converge at a central point proximate an end of the base 402. In this example, the blades 404 also have a compound curved structure such that the blades 404 curve in multiple directions and at varying rates. This example configuration provides a high efficiency, single-part fan wheel that is easily producible by the processes disclosed herein in an economical fashion, but which is not producible through conventional manufacturing methods, such as casting or machining, without incurring prohibitive costs and/or requiring forming multiple separate parts that are later joined together.

FIG. 50 shows a comparison of static efficiencies against inches of water column (Inch WC) between the example of the fan wheel 400 shown in FIG. 49 and a convention HVAC-type fan wheel having a standard geometry and an equivalent capacity. FIG. 50 shows the static efficiency improvement of the example of the fan wheel 400 shown in FIG. 49 over the conventional fan wheel configuration. As shown in FIG. 50, the example of the fan wheel 400 shown in FIG. 49 has improved static efficiencies over the conventional fan wheel configuration at every static pressure level, and in particular, at low static pressure levels.

It is understood that the above description is intended to be illustrative, and not restrictive. The material has been presented to enable any person skilled in the art to make and use the concepts described herein, and is provided in the context of particular embodiments, variations of which will be readily apparent to those skilled in the art (e.g., some of the disclosed embodiments may be used in combination with each other). Many other embodiments will be apparent to those of skill in the art upon reviewing the above description. The scope of the embodiments herein therefore should be determined with reference to the appended claims, along with the full scope of equivalents to which such claims are entitled.

The various embodiments described above are provided by way of illustration only and should not be construed to be limiting in any way. Various modifications can be made to the embodiments described above without departing from the true spirit and scope of the disclosure.

What is claimed is:

1. A fan assembly, comprising:

a plurality of fans arranged in an array, wherein each of the fans comprises:

an axial flow housing, manufactured as a single, seamless component without any welds, defining an inlet end and an outlet end aligned along a central longitudinal axis of the axial flow housing, the axial flow housing including an external housing component and an internal housing component cooperating to define an annulus;

a motor at least partially housed within the internal housing; and a fan wheel having at least an axial airflow characteristic operably coupled to the motor and positioned in fluid communication with the annulus.

2. The fan assembly of claim 1, wherein the fan assembly is configured to direct parallel airflows along the longitudinal axes of each of the plurality of fans.

3. The fan assembly of claim 1, wherein each fan is configured to output a volume of air in a range of about 900 to about 24,500 cubic feet per minute.

4. The fan assembly of claim 1, wherein the fan wheel includes a centralized hub defining an outer surface terminating in a hub diameter, and a wheel cone defining an inner surface terminating in a wheel cone diameter.

5. The fan assembly of claim 4, wherein the hub diameter is between about 7 inches and about 23 inches, and the wheel cone diameter is between about 12 inches and about 36 inches.

6. The fan assembly of claim 4, wherein the internal housing component defines an exterior surface shaped to create a smooth transition between the internal housing component and the outer surface of the centralized hub of the fan wheel, and the external housing component defines an inner surface shaped to create a smooth transition between the external housing component and the inner surface of the wheel cone of the fan wheel.

7. The fan assembly of claim 4, further comprising a bell inlet defining an air inlet in fluid communication with the fan wheel.

8. The fan assembly of claim 7, wherein the bell inlet defines an air inlet surface shaped to create a smooth transition between the bell inlet and the inner surface of the wheel cone of the fan wheel.

9. The fan assembly of claim 1, wherein each fan has a maximum sound level of 72 dBA during operation.

10. The fan assembly of claim 1, wherein the fan wheel comprises a mixed flow fan wheel having both axial and centrifugal airflow characteristics.

11. The fan assembly of claim 1, wherein the axial flow housing further comprises one or more stator blades operably coupled between the internal housing component and the external housing component.

12. The fan assembly of claim 1, wherein at least a portion of the axial flow housing is made of a durable non-ferrous material.

13. The fan assembly of claim 1, wherein at least a portion of the axial flow housing is made of a polymeric material.

14. The fan assembly of claim 1, wherein at least a portion of the axial flow housing is produced by 3D printing.

15. A low noise fan assembly, comprising:

an axial flow housing, manufactured as a single, seamless component without any welds, defining an inlet end and an outlet end aligned along a central longitudinal axis of the axial flow housing, the axial flow housing including an external housing component and an internal housing component cooperating to define an annulus, wherein one or more stator blades are positioned within the annulus between the internal housing component and the external housing component, and wherein the external housing component, internal housing component, and one or more stator blades are constructed of a non-metallic material having the effect of dampening vibration associated with operation;

a motor at least partially housed within the internal housing component; and a mixed flow fan wheel having both axial and centrifugal airflow characteristics operably coupled to the motor and positioned in fluid communication with the annulus, wherein the internal housing component defines an exterior housing surface shaped to create a smooth transition between the internal housing component and an exterior fan surface of the mixed flow fan wheel, and the external housing component defines an inner housing surface shaped to create a smooth transition between the external housing component and the inner fan surface of the mixed flow fan wheel having the effect of reducing aerodynamic noise associated with turbulence.

16. The low noise fan assembly of claim 15, wherein the mixed flow fan wheel includes a centralized hub defining an outer surface terminating in a hub diameter, and a wheel cone defining an inner surface terminating in a wheel cone diameter.

17. The low noise fan assembly of claim 16, wherein the hub diameter is between about 7 inches and about 23 inches, and the wheel cone diameter is between about 12 inches and about 36 inches.

18. The low noise fan assembly of claim 15, further comprising a bell inlet defining an air inlet in fluid communication with the mixed flow fan wheel.

19. The low noise fan assembly of claim 18, wherein the bell inlet defines an air inlet surface shaped to create a smooth transition between the bell inlet and an inner fan surface of the mixed flow fan wheel.

20. The low noise fan assembly of claim 15, wherein the low noise fan assembly has a maximum sound level of 68 dBA at the inlet end.

21. The low noise fan assembly of claim 15, wherein the low noise fan assembly has a maximum sound level of 72 dBA within the annulus.

22. The low noise fan assembly of claim 15, wherein at least a portion of the axial flow housing is made of a durable non-ferrous material.

23. The low noise fan assembly of claim 15, wherein at least a portion of the axial flow housing is made of a polymeric material.

24. The low noise fan assembly of claim 15, wherein at least a portion of the axial flow housing is produced by 3D printing.

* * * * *